US006515559B1

(12) United States Patent
Yamakawa et al.

(10) Patent No.: US 6,515,559 B1
(45) Date of Patent: Feb. 4, 2003

(54) IN-BAND-FLAT-GROUP-DELAY TYPE DIELECTRIC FILTER AND LINEARIZED AMPLIFIER USING THE SAME

(75) Inventors: Takehiko Yamakawa, Osaka (JP); Toru Yamada, Osaka (JP); Toshio Ishizaki, Hyogo (JP); Minoru Tachibana, Osaka (JP); Toshiaki Nakamura, Nara (JP); Hiroyuki Nakamatsu, Kyoto (JP)

(73) Assignee: Matsushita Electric Industrial Co., Ltd, Kadoma (JP)

( * ) Notice: Subject to any disclaimer, the term of this patent is extended or adjusted under 35 U.S.C. 154(b) by 0 days.

(21) Appl. No.: 09/618,714

(22) Filed: Jul. 18, 2000

(30) Foreign Application Priority Data

Jul. 22, 1999 (JP) ..... 11-207633
Oct. 20, 1999 (JP) ..... 11-297776
Mar. 13, 2000 (JP) ..... 2000-068304

(51) Int. Cl.[7] ..... H01P 1/20; H01P 7/10

(52) U.S. Cl. ..... 333/202; 333/206; 333/207; 333/219.1

(58) Field of Search ..... 333/202, 206, 333/207, 219.1

(56) References Cited

U.S. PATENT DOCUMENTS 4,223,287 A * 9/1980 Nishikawa et al. ..... 333/206
5,969,584 A * 10/1999 Huang et al. ..... 333/202
6,081,175 A * 6/2000 Duong et al. ..... 333/212
6,262,639 B1 * 7/2001 Shu et al. ..... 333/202

FOREIGN PATENT DOCUMENTS

JP 402094901 A * 4/1990
JP 06260807 A * 9/1994
JP 11-68409 3/1999

OTHER PUBLICATIONS

High–Power GaAs FET Amplifiers, 7.3.2 Linearized Amplifiers.

* cited by examiner

*Primary Examiner*—Patricia T. Nguyen
(74) *Attorney, Agent, or Firm*—Merchant & Gould P.C.

(57) ABSTRACT

A small in-band-flat-group-delay type dielectric filter having low-loss characteristics with a small amplitude deviation and uniform-group-delay frequency characteristics is obtained, which enables broad-band characteristics to be obtained easily. The in-band-flat-group-delay type dielectric filter includes a plurality of dielectric coaxial resonators, a coupling circuit comprising a combination of reactive elements, with which the dielectric coaxial resonators are coupled to one another, and input/output terminals connected to ends of the coupling circuit. The dielectric coaxial resonators coupled to the input/output terminals are allowed to have a different characteristic impedance from that of the inter-stage dielectric coaxial resonators.

20 Claims, 29 Drawing Sheets

$f_c < f_d$ $\Delta f_1 > 2 \times \Delta f_2$

IN-BAND-FLAT-GROUP-DELAY TYPE DIELECTRIC FILTER AND LINEARIZED AMPLIFIER USING THE SAME

FIELD OF THE INVENTION

The present invention relates to an in-band-flat-group-delay type dielectric filter having a uniform group delay time, which mainly is used in high-frequency radio equipment utilizing a high frequency band and to a linearized amplifier using the same.

BACKGROUND OF THE INVENTION

Recently, many linearized amplifiers have come to be used in base station radio equipment for mobile communication systems to reduce the sizes of base stations.

FIG. 32 is a block diagram showing a feedforward amplifier as a typical example of linearized amplifiers. The feedforward amplifier shown in FIG. 32 includes delay circuits 321, directional couplers 322, 323, and 325, a main amplifier 324, an error amplifier 326, an input terminal 327, and an output terminal 328. Main signals are input from the input terminal 327 and are amplified in the main amplifier 324. In the signals amplified in the main amplifier 324, distortion occurs and only distorted components are detected in a carrier cancellation loop. The feedforward amplifier is a circuit in which only the distorted components are eliminated, from the signals including the distortion, which has been amplified in the main amplifier 324, in the distortion cancellation loop, and only signals including no distortion are extracted. The details of its operation are described in "High-Power GaAs FET Amplifiers" by John L. B. Walker (issued by Artech House (Boston, London), see 7.3.2 Linearized Amplifiers). In the carrier cancellation loop and the distortion cancellation loop, in order to allow the group delay times of the two signals divided in the directional coupler 323 to coincide exactly with each other and to synthesize them in the directional coupler 325, strict and fine adjustment of the group delay times is required for the delay circuits 321.

Conventionally, in a distortion compensating circuit in a linearized amplifier, for the purpose of adjusting group delay times, a delay device using a coaxial cable such as one with a diameter of about 2 cm and a length of at least 10 m has been used in general.

However, such a delay device is large and has a great insertion loss, which have been disadvantages. The great insertion loss requires the device to have a higher output power, thus causing various problems such as an increase in the size of equipment, a high power consumption, a further complicated configuration relating to radiation, or the like, which have been obstacles to obtaining small base station equipment. Furthermore, it is required to vary the physical length of a cable for carrying out the fine adjustment of the group delay time. Therefore, each time the length is varied, it is necessary to disconnect connectors and to cut the cable, resulting in a poor working efficiency, which has been a problem.

On the other hand, a dielectric filter mainly has been used for removing undesired signals as a bandpass filter or a band stop filter, and particularly, its amplitude transfer characteristics have received attention. Therefore, conventional dielectric filters have low losses, but a deviation in group delay time depending on frequencies is great. For this reason, it has been considered that the conventional dielectric filters cannot be used for delay devices providing uniform group delays. Moreover, it has been hardly intended to flatten both amplitude characteristics and group delay frequency characteristics at the same time. In addition, there has been no example of achieving both the low loss and the reduction in size using a dielectric.

SUMMARY OF THE INVENTION

The present invention is intended to provide an in-band-flat-group-delay type dielectric filter with a small size, a low loss, and uniform-group-delay frequency characteristics.

The present invention also is intended to provide a dielectric filter in which a fine adjustment of a group delay time can be carried out easily.

Furthermore, the present invention is intended to provide a small linearized amplifier using such a dielectric filter.

An in-band-flat-group-delay type dielectric filter according to a first basic configuration of the present invention includes a plurality of dielectric coaxial resonators, a coupling circuit comprising a combination of reactive elements, with which the respective dielectric coaxial resonators are coupled to one another, and input/output terminals connected to ends of the coupling circuit. The dielectric coaxial resonators coupled to the input/output terminals have a different characteristic impedance from that of the other inter-stage dielectric coaxial resonators. According to this configuration, a small filter with a low loss and uniform-group-delay frequency characteristics can be obtained. Therefore, for example, when a cable-type delay device used in a feedforward linearized amplifier or the like is replaced by the filter with the configuration described above, due to a lower loss, a load on the amplifier is reduced and a margin in heat radiation design can be obtained, and at the same time, the size of the amplifier can be reduced. Furthermore, broad-band characteristics can be obtained and thus uniform-group-delay frequency characteristics can be obtained together with the low-loss characteristics with a small amplitude deviation. In the above-mentioned configuration, it is preferred to set the characteristic impedance of the dielectric coaxial resonators coupled to the input/output terminals to be higher than that of the other inter-stage dielectric coaxial resonators.

In the above basic configuration, it is preferable that both deviations in group delay time and in amplitude between the input/output terminals fall within predetermined certain deviation values, respectively, at the center frequency and within a specified frequency band around the center frequency at the same time, and the minimum of the group delay time within a passband is at least one nanosecond.

In the above-mentioned basic configuration, preferably, the dielectric coaxial resonators coupled to the input/output terminals are half-wave dielectric resonators with their both ends opened. According to this configuration, the Q value indicating the performance of the resonators is high, thus obtaining the effects of reducing the size and loss.

In the above-mentioned basic configuration, preferably, the dielectric coaxial resonators coupled to the input/output terminals are quarter-wave dielectric resonators with their one ends short-circuited, and the inter-stage dielectric coaxial resonators are half-wave dielectric resonators with their both ends opened. According to this configuration, a slope parameter can be varied between the input/output stages and the interstages, thus facilitating the manufacture.

In the above-mentioned basic configuration, it is possible to allow the dielectric coaxial resonators coupled to the input/output terminals to have a different characteristic impedance from that of the other inter-stage dielectric coaxial resonators by using dielectric materials with different dielectric constants. According to this configuration, the characteristic impedance can be varied easily, multistage dielectric resonators can be obtained while excellent input/output matching is maintained, the broad-band characteristics can be obtained, and low-loss characteristics with a small amplitude deviation and uniform-group-delay frequency characteristics can be obtained.

The characteristic impedance of the dielectric coaxial resonators coupled to the input/output terminals may be made different from that of the inter-stage dielectric coaxial resonators by making diameter ratios of the dielectric coaxial resonators coupled to the input/output terminals and the inter-stage dielectric coaxial resonators different. According to this configuration, the resonators are allowed to have different characteristic impedances easily. Therefore, even when, for instance, dielectric ceramic materials with the same relative dielectric constant are used, the above-mentioned configuration can be achieved, resulting in an easier manufacture.

Furthermore, it is preferable that the above-mentioned basic configuration further includes a transmission line and a directional coupler. The coupling circuit is formed of capacitors, which are formed on a coupling board formed on a dielectric substrate, for coupling the dielectric coaxial resonators. An in-band-flat-group-delay type dielectric filter, which includes the coupling board and the dielectric coaxial resonators, and the directional coupler are combined via the transmission line to form one body. According to this configuration, the loss is reduced and the size reduction also can be achieved easily.

In this configuration, it is possible to construct the coupling circuit by forming capacitors on a first dielectric substrate, forming the directional coupler on a second dielectric substrate, and then combining the first and second dielectric substrates to form one body. According to this configuration, the coupling capacitors between the stages of the resonators and the directional coupler are formed on the same dielectric substrate, thus obtaining effects of enabling a simple manufacturing process and the reductions in size and in loss.

In the above mentioned basic configuration, it is possible to regulate the resonance frequencies of the dielectric coaxial resonators by providing metallic screw tuners positioned adjacent to and in parallel to open ends of the dielectric coaxial resonators and varying the distances between the screw tuners and the dielectric coaxial resonators. According to this configuration, the regulation operation is facilitated and thus the productivity is improved drastically since the filter is a multistage filter, and in addition, an accurate regulation is possible, thus achieving a higher performance.

Furthermore, in the above-mentioned basic configuration, the resonance frequencies of the dielectric coaxial resonators can be regulated by providing metal fittings for frequency regulation electrically connected to internal conductors of the dielectric coaxial resonators and metallic screw tuners positioned adjacent to and in parallel to the metal fittings, and varying the distances between the metal fittings and the screw tuners. According to this configuration, the regulation operation is facilitated and thus the productivity is improved drastically since the filter is a multistage filter, and in addition, an accurate regulation is possible, thus achieving a higher performance.

In the above-mentioned basic configuration, metallic screw tuners provided movably in a direction perpendicular to the open ends of the respective dielectric coaxial resonators are inserted into inner holes of the dielectric coaxial resonators via dielectrics or insulators, and by varying the insertion lengths, the resonance frequencies of the dielectric coaxial resonators can be regulated. According to this configuration, the regulation operation is facilitated and thus the productivity is improved drastically since the filter is a multistage filter, and in addition, an accurate regulation is possible, thus achieving a higher performance.

In any one of the above-mentioned configurations using the screw tuners, the screw tuners may be attached to a case, and may be formed from gold, silver, or copper or may have surfaces plated with gold, silver, or copper. According to this configuration, a high no-load Q value of the resonators can be maintained, thus obtaining filter characteristics with a low loss and a high performance.

Furthermore, the frequency may be regulated by attaching the screw tuners to the case with one ends of the respective screw tuners being exposed to the outside of the case, and regulating the positions of the screw tuners from the outside of the case. According to this configuration, the regulation operation is facilitated and thus the productivity is improved drastically since the filter is a multistage filter, and in addition, an accurate regulation is possible, thus achieving a higher performance. In addition, the whole can be shielded, thus obtaining an effect of being resistant to noise jamming.

The in-band-flat-group-delay type dielectric filter of the present invention can have a configuration in which a plurality of filter blocks formed of in-band-flat-group-delay type dielectric filters with the above-mentioned basic configuration are included and the plurality of filter blocks are cascaded with a transmission line having a characteristic impedance whose value is substantially the same as that of an input/output impedance. According to this configuration, the respective filters can be regulated separately, thus highly facilitating the regulation of the whole.

In this configuration, preferably, the plurality of filter blocks are separated by shielding cases individually. According to this configuration, the characteristics of each filter block can be found accurately and therefore the regulation is facilitated.

In the above-mentioned basic configuration, it is possible that the frequency band with a uniform group delay (hereinafter referred to as a "uniform-group-delay frequency band") is within a passband in amplitude transfer characteristics and a variation in amplitude in the amplitude transfer characteristics within the uniform-group-delay frequency band is smaller than that in amplitude in the whole passband in the amplitude transfer characteristics outside the uniform-group-delay frequency band. In this configuration, it is possible that the minimum of insertion loss within the passband in the amplitude transfer characteristics falls within the uniform-group-delay frequency band. Moreover, in the above-mentioned basic configuration, it also is possible that a uniform-group-delay frequency band is within a passband in amplitude transfer characteristics and the center frequency of the uniform-group-delay frequency band is higher than that of the passband in the amplitude transfer characteristics. According to these configurations, further excellent characteristics that are desirable for a delay device can be obtained, thus obtaining a filter that can be produced and regulated easily and has a good balance between the amplitude characteristics and the delay characteristics.

In the above-mentioned basic configuration, it is possible that a uniform-group-delay frequency band is within a passband in amplitude transfer characteristics and the passband in the amplitude transfer characteristics has a width at least twice as wide as that of the uniform-group-delay frequency band. According to this configuration, the reduction in loss and uniform-group-delay frequency characteristics can be obtained and further excellent characteristics that are desirable for a delay device also can be obtained, thus obtaining a filter that can be produced and regulated easily and has a good balance between the amplitude characteristics and the delay characteristics.

In the above-mentioned basic configuration, it is possible that the frequency characteristics in group delay time have peak values at both edges of a passband in amplitude transfer characteristics and the peak value at the lower edge of the passband in the amplitude transfer characteristics is larger than that at the upper edge. It also is possible that a return loss within the uniform-group-delay frequency band has a ripple, and the minimum of the ripple within the uniform-group-delay frequency band is larger than that of ripple in a return loss outside the uniform-group-delay frequency band, and decreases from the center portion toward the both edges of the passband in the amplitude transfer characteristics. According to these configurations, further excellent characteristics that are desirable for a delay device can be obtained, thus obtaining a filter that can be produced and regulated easily and has a good balance between the amplitude characteristics and the delay characteristics.

An in-band-flat-group-delay type dielectric filter according to a second basic configuration includes a plurality of dielectric coaxial resonators, a coupling circuit comprising a combination of reactive elements, with which the respective dielectric coaxial resonators are coupled to one another, and input/output terminals connected to ends of the coupling circuit. Both deviations in group delay time and in amplitude between the input/output terminals fall within specified certain deviation values, respectively, at the same time at the center frequency and within a specified passband around the center frequency. At least one reactive element included in the coupling circuit is a variable reactive element. Thus, the group delay time within the passband can be varied.

According to this configuration, the group delay time can be varied continuously by the variable reactive element. Therefore, in a feedforward circuit in a linearized amplifier or the like, the efficiency of regulation is improved, and thus productivity and mass-productivity are improved.

The group delay time within the passband may be varied by: providing a plurality of dielectric coaxial resonators; connecting the respective adjacent dielectric coaxial resonators via at least two reactive elements connected in series; connecting a portion between the reactive elements and a ground via a variable reactive element; and varying the value of the variable reactive element.

In the above configuration, as the variable reactive element, a trimmer capacitor or a varactor diode can be used.

An in-band-flat-group-delay type dielectric filter according to a third basic configuration of the present invention includes a plurality of dielectric resonators, a main circuit comprising series coupling capacitors, with which the dielectric resonators are connected to one another, and an auxiliary circuit for coupling the main circuit with capacitors by bypass coupling. Both deviations in group delay time and in amplitude between input/output terminals fall within specified certain deviation values, respectively, at the same time at the center frequency and within a specified frequency band around the center frequency.

According to this configuration, the group delay frequency characteristics have no large peak in the vicinities of the edges of a passband and the uniform-group-delay frequency band is wide, thus achieving a number of group delays with a small number of stages.

In the above-mentioned third basic configuration, the following configuration can be obtained: two of the series coupling capacitors connect between the adjacent dielectric resonators; each one end of parallel bypass capacitors included in the auxiliary circuit is connected to a junction between the two of the series coupling capacitors; and the other ends of the adjacent parallel bypass capacitors are connected to be short circuited or via at least one of the series bypass capacitors.

In the third basic configuration, the following configuration also can be obtained: one of the series coupling capacitors connects between the adjacent dielectric resonators; each one end of parallel bypass capacitors included in the auxiliary circuit is connected to a junction between the series coupling capacitors; and the other ends of the adjacent parallel bypass capacitors are connected to be short circuited or via at least one of the series bypass capacitors.

In the above configuration, at least one of the parallel bypass capacitors may be opened. In addition, at least one of the series bypass capacitors may be short circuited.

In any one of the configurations according to the third basic configuration described above, the following configuration can be obtained. That is, the frequency characteristics in group delay have a peak value at the lower edge of a passband in amplitude transfer characteristics, and uniform-group-delay frequency characteristics within the passband. In a higher frequency band than the upper edge of the passband, the frequency characteristics in group delay frequency characteristics do not increase from a uniform group delay time within the passband but decrease.

A linearized amplifier of the present invention includes a dielectric filter with any one of the above-mentioned configurations, and a group delay time in a distortion compensating circuit is regulated by the dielectric filter. This configuration achieves the reductions in size of base station radio equipment and in power consumption, the simplification of configuration relating to radiation, and the like.

In the linearized amplifier with this configuration, the distortion compensating circuit can be designed as a feedforward type. According to this configuration, the in-band-flat-group-delay type dielectric filter is inserted into the main path in which a large current passes, thus further improving the effects of the reductions in size of base station radio equipment and in power consumption, the simplification of configuration relating to radiation, and the like.

In the linearized amplifier with the above-mentioned configuration, it is possible to set the uniform-group-delay frequency band width in the dielectric filter to be at least three times as wide as a required bandwidth of the amplifier. According to this configuration, the intermodulation distortion of third order or higher in the amplifier can be compensated, thus obtaining an amplifier causing a low distortion.

DETAILED DESCRIPTION OF THE INVENTION

FIRST EMBODIMENT

An in-band-flat-group-delay type dielectric filter according to a first embodiment of the present invention is described in detail with reference to the drawings as follows.

Figure 1A:
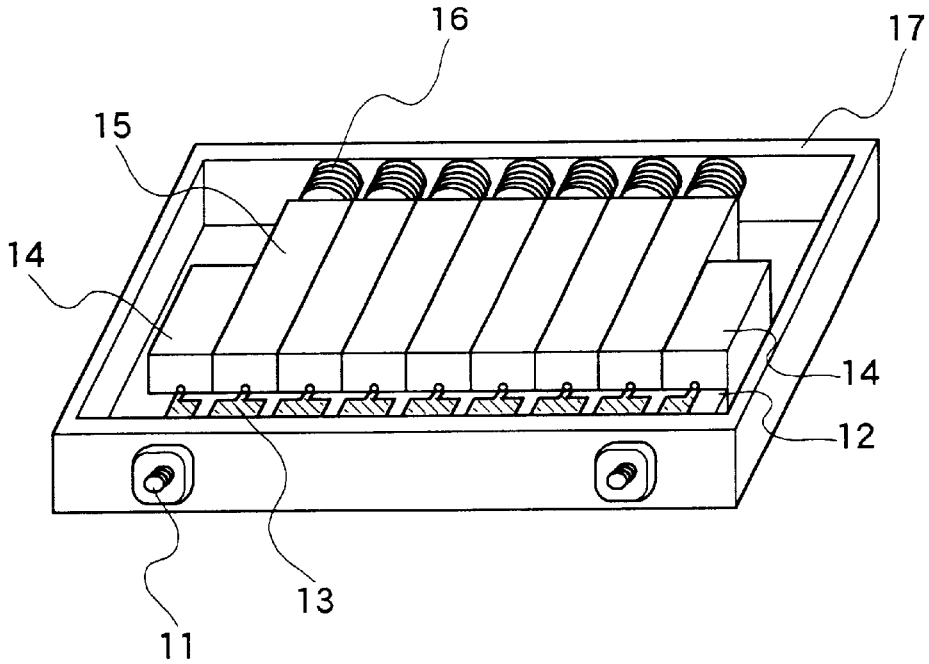
FIG. 1A is a perspective view of an in-band-flat-group-delay type dielectric filter according to a first embodiment of the present invention, which is shown with an upper wall of its case being removed.
Figure 1B:
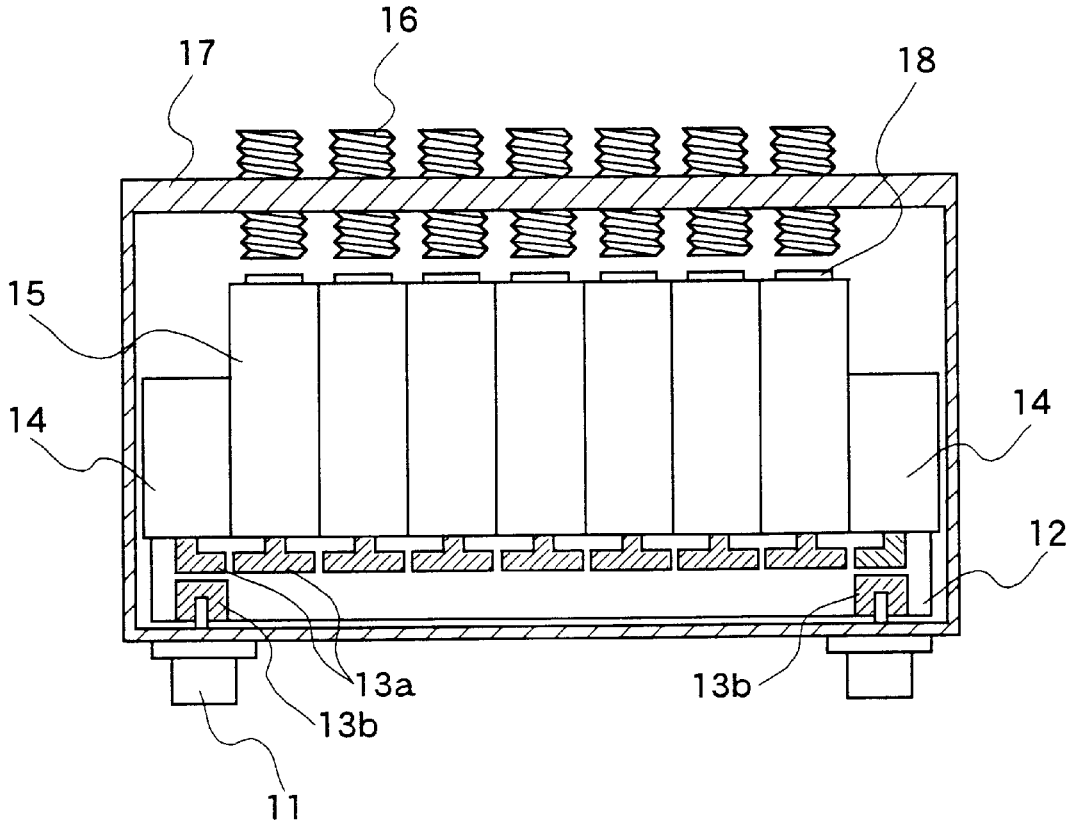
FIG. 1B is a plan view of the same.

FIGS. 1A and 1B show the inside of the dielectric filter according to the first embodiment, with the upper wall of a case 17 being removed. In FIGS. 1A and 1B, numeral 11 denotes input/output connectors. Numeral 12 indicates an alumina coupling board. Numerals 13*a* and 13*b* denote copper-plated electrodes forming coupling capacitors, which are formed on the coupling board 12. Numeral 14 denotes quarter-wave coaxial dielectric resonators with a relative dielectric constant $\epsilon r$ of 21, which are coupled to the input/output connectors 11. Numeral 15 indicates,half-wave coaxial dielectric resonators with a relative dielectric constant $\epsilon r$ of 43. Numeral 16 indicates gold-plated screw tuners for regulating a resonance frequency. Numeral 18 shown in FIG. 1B indicates silver-plated metal fittings for frequency regulation, which are provided for increasing loading capacitance between the screw tuners 16 and the half-wave coaxial dielectric resonators 15.

With respect to the quarter-wave coaxial dielectric resonators 14 and the half-wave coaxial dielectric resonators 15, their one end faces are aligned and their respective external conductors are grounded to the case 17. The copper-plated electrodes 13 are electrically connected to internal conductors of the quarter-wave coaxial dielectric resonators 14 and the half-wave coaxial dielectric resonators 15 with solder or the like. To the copper-plated electrodes 13*b* at both ends of the alumina coupling board 12, internal conductors of the input/output connectors 11 are connected with solder or the like.

Figure 2:
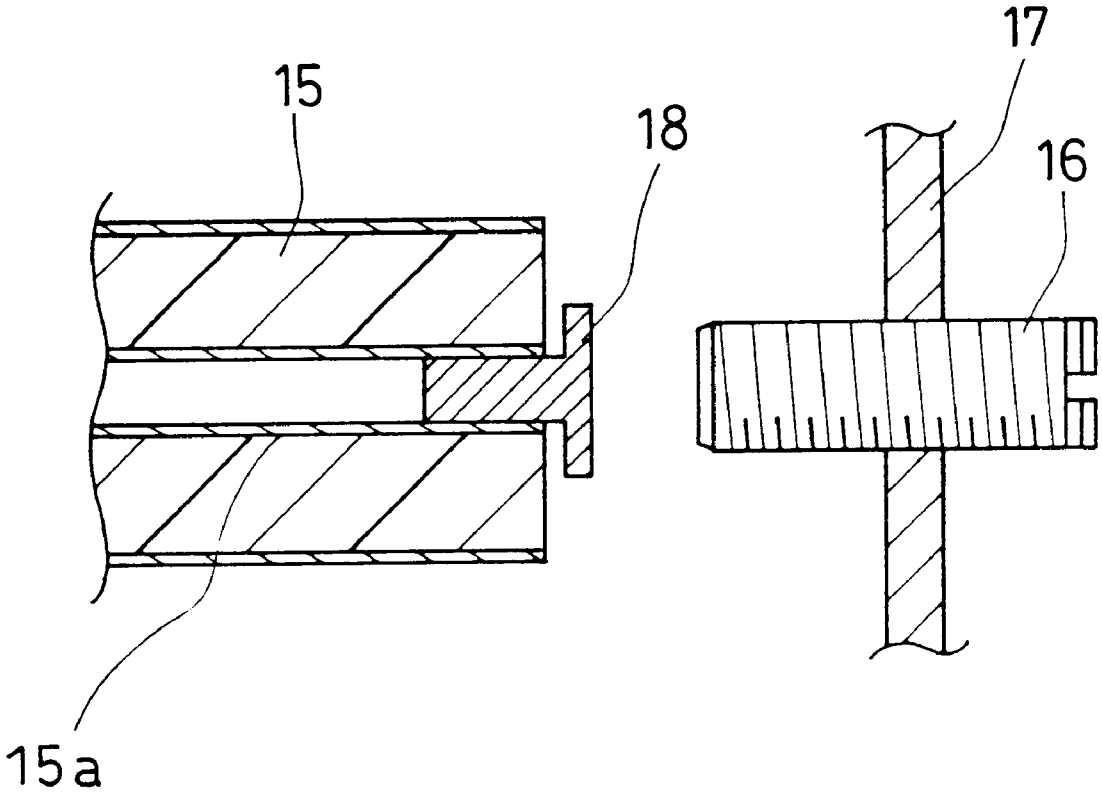
FIG. 2 is an enlarged sectional view of an end portion of a half-wave coaxial dielectric resonator included in the dielectric filter shown in FIGS. 1A and 1B.

FIG. 2 is an enlarged sectional view of an end portion, at the side on which the half-wave coaxial dielectric resonators 15 are not connected to the copper-plated electrodes 13*a*, of a half-wave coaxial dielectric resonator 15 included in the dielectric filter shown in FIG. 1A. To an end of an internal conductor 15*a* of the half-wave coaxial dielectric resonator 15, the metal fitting 18 for frequency regulation is connected and faces the screw tuner 16. The screw tuner 16 is inserted into a screw hole provided in the case 17 serving as a ground, and is rotated to adjust the distance between the metal fitting 18 and the screw tuner 16.

With respect to the in-band-flat-group-delay type dielectric filter with the configuration described above, its operation is described as follows.

Figure 3:
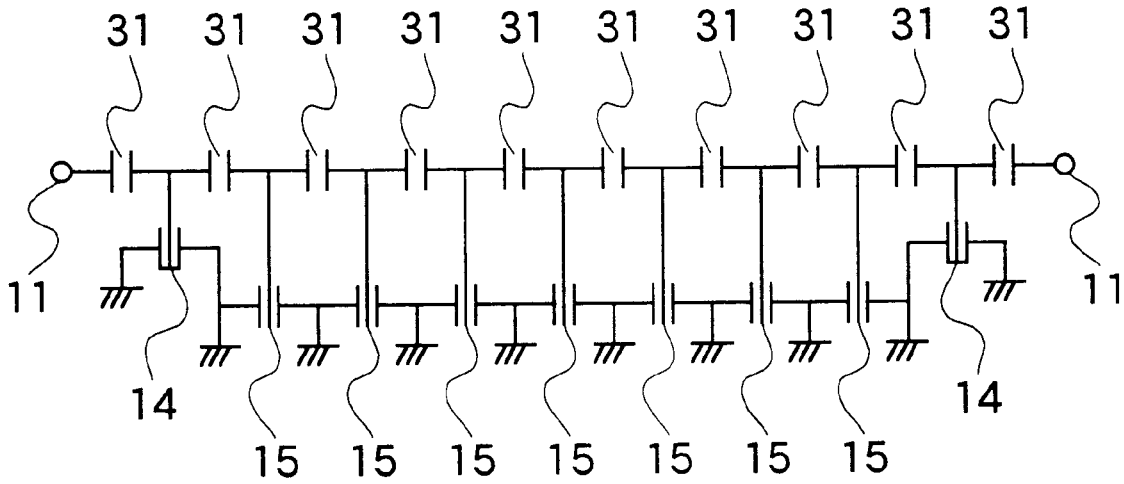
FIG. 3 is a schematic diagram of an equivalent circuit of the dielectric filter shown in FIGS. 1A and 1B.

FIG. 3 is a schematic diagram of an equivalent circuit of the in-band-flat-group-delay type dielectric filter according to the first embodiment shown in FIG. 1. In FIG. 3, the respective parts corresponding to those in FIG. 1 are indicated with the same numbers as in FIG. 1. Numeral 31 denotes coupling capacitors formed of the electrodes 13*a* and 13*b* shown in FIG. 1. In this way, the respective dielectric resonators 14 and 15 are coupled via coupling capacitors 31, thus obtaining a multistage bandpass filter. In this specification, for example, as shown in FIG. 3, series capacitors coupling between input/output terminals 11, between which the dielectric resonators 14 and 15 are connected, are referred to as "coupling capacitors".

Figure 4A:
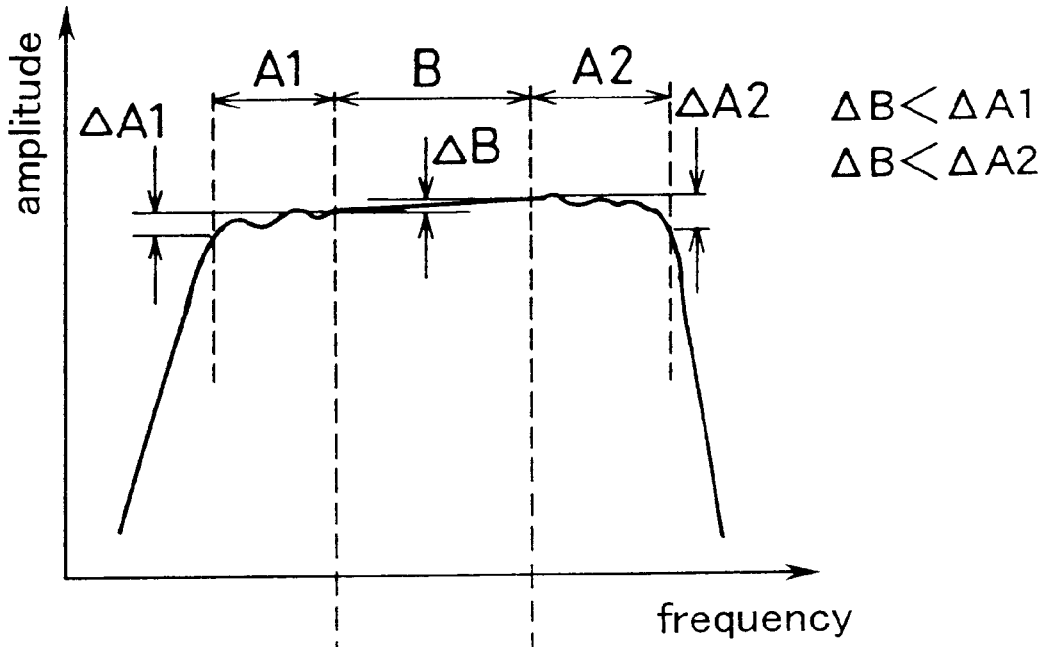
FIG. 4A is a graph showing transfer characteristics of the dielectric filter shown in FIGS. 1A and 1B.
Figure 4B:
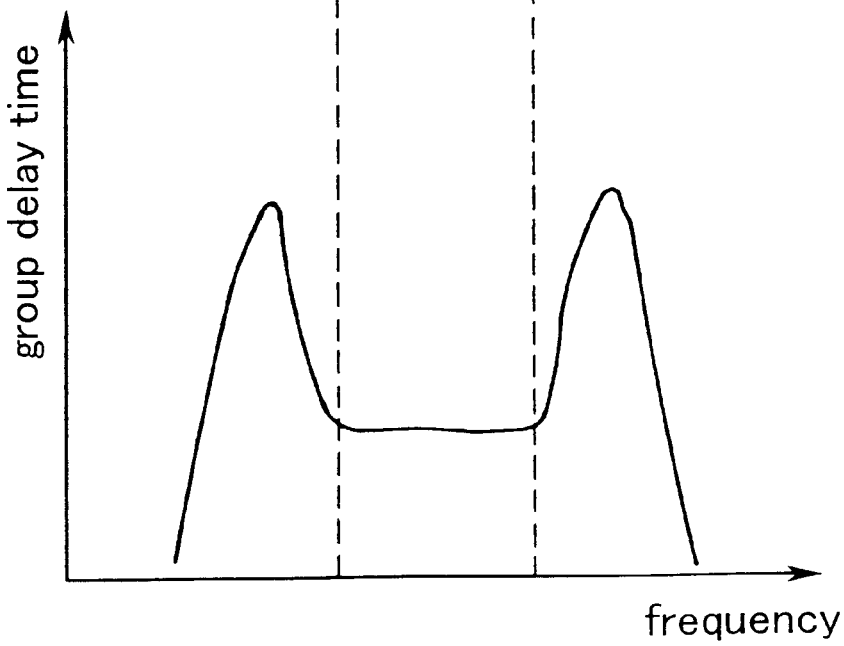
FIG. 4B is a graph showing group delay frequency characteristics of the dielectric filter shown in FIGS. 1A and 1B.

Characteristics of this filter are shown in FIGS. 4A and 4B. By optimizing the resonance frequencies of the dielectric resonators 14 and 15 and the values of the coupling capacitors 31, the characteristics shown in FIGS. 4A and 4B can be obtained. In other words, a uniform-group-delay frequency band (indicated as a range B in FIG. 4B) is within a passband in amplitude transfer characteristics, thus obtaining flat characteristics in which the variation $\Delta B$ in amplitude in the transfer characteristics within the uniform-group-delay frequency band is smaller than the variations $\Delta A1$ and $\Delta A2$ in the passband in amplitude transfer characteristics outside the uniform-group-delay frequency band (i.e.$\Delta B<\Delta A1$ and $\Delta B<\Delta A2$). Furthermore, by connecting the metal fitting 18 to the internal conductor 15*a* of the half-wave coaxial dielectric resonator 15 as shown in FIG. 2, the area for forming a capacitor between the internal conductor 15*a* of the dielectric resonator 15 and the screw tuner 16 increases, thus increasing the frequency variable range. In addition, the screw tuners 16 can be regulated from the outside of the case 17 and therefore the regulation of the filter is facilitated. Thus, desired characteristics can be obtained easily.

Figure 5:
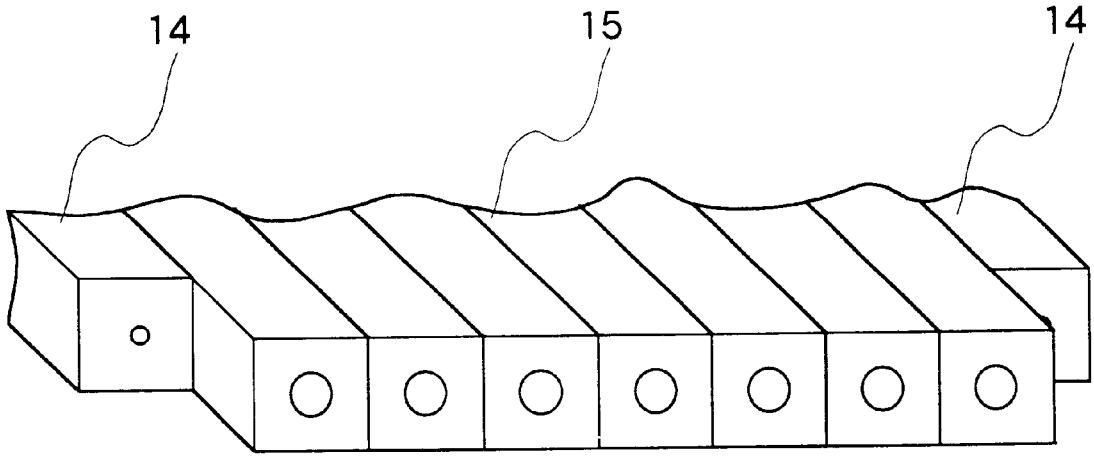
FIG. 5 is a perspective view showing end portions of the coaxial dielectric resonators included in the dielectric filter shown in FIG. 1 with metal fittings for frequency regulation being removed.

FIG. 5 is a perspective view showing end faces of the quarter-wave coaxial dielectric resonators 14 and the half-wave coaxial dielectric resonators 15 included in the in-band-flat-group-delay type dielectric filter according to the first embodiment of the present invention, with the metal fittings 18 being removed. The inner diameter of the dielectric resonators 14 in the input/output stages is smaller than that of the inter-stage dielectric resonators 15. Therefore, it is possible to set the characteristic impedance of the dielectric resonators 14 in the input/output stages to be higher than that of the inter-stage dielectric resonators 15. This enables broad-band characteristics to be obtained easily and thus uniform-group-delay frequency characteristics can be obtained together with low-loss characteristics with a small amplitude deviation. In addition, the same effect also can be obtained by allowing the characteristic impedance of the coaxial dielectric resonators 14 coupled to the input/output terminals to be different from that of the inter-stage coaxial dielectric resonators 15, for example, by setting the dielectric constants of the dielectric resonators 14 and the dielectric resonators 15 to be 21 and 43, respectively, as described above.

Figure 6:
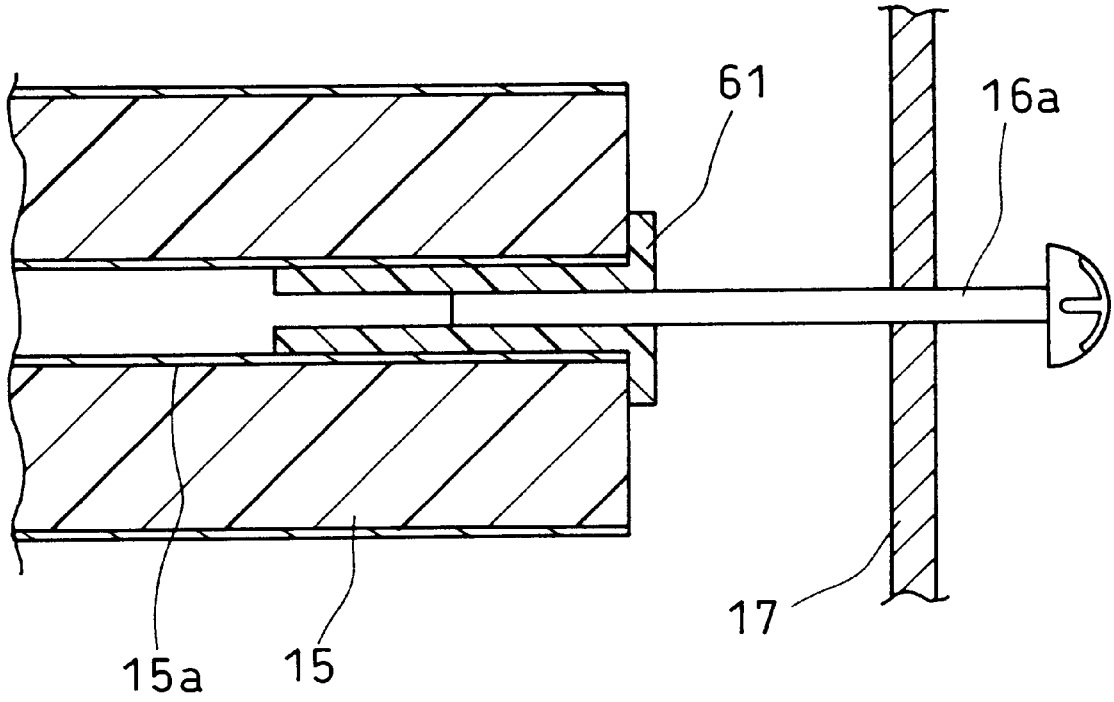
FIG. 6 is an enlarged sectional view showing an end portion of another example of the half-wave coaxial dielectric resonator included in the dielectric filter according to the first embodiment of the present invention.

When the end faces of the half-wave coaxial dielectric resonators 15 are formed as shown in the sectional view illustrated in FIG. 6, frequency can be regulated more easily. The configuration shown in FIG. 6 is different from that shown in FIG. 2 in that the metal fitting 18 is omitted, a tuner supporter 61 formed of a dielectric with a low dielectric constant, such as "Teflon" or the like, is inserted into the inner hole of the dielectric resonator 15, and a screw tuner 16*a* is inserted into a hollow portion. By inserting the screw tuner 16*a* into the inner hole of the dielectric resonator 15 via the tuner supporter 61, the screw tuner 16*a* serving as a ground can form a capacitor with the internal conductor 15*a* of the dielectric resonator 15 without causing short circuit. Furthermore, since the capacitance is multiplied by a relative dielectric constant compared to that obtained in the case where the capacitor is formed via air, a frequency regulation range can be broadened. In addition, since the screw tuner 16*a* is held by and inside the tuner supporter 61, the distance between the screw tuner 16*a* and the internal conductor 16*a* of the dielectric resonator 15 is constant, thus obtaining stable characteristics.

Figure 7A:
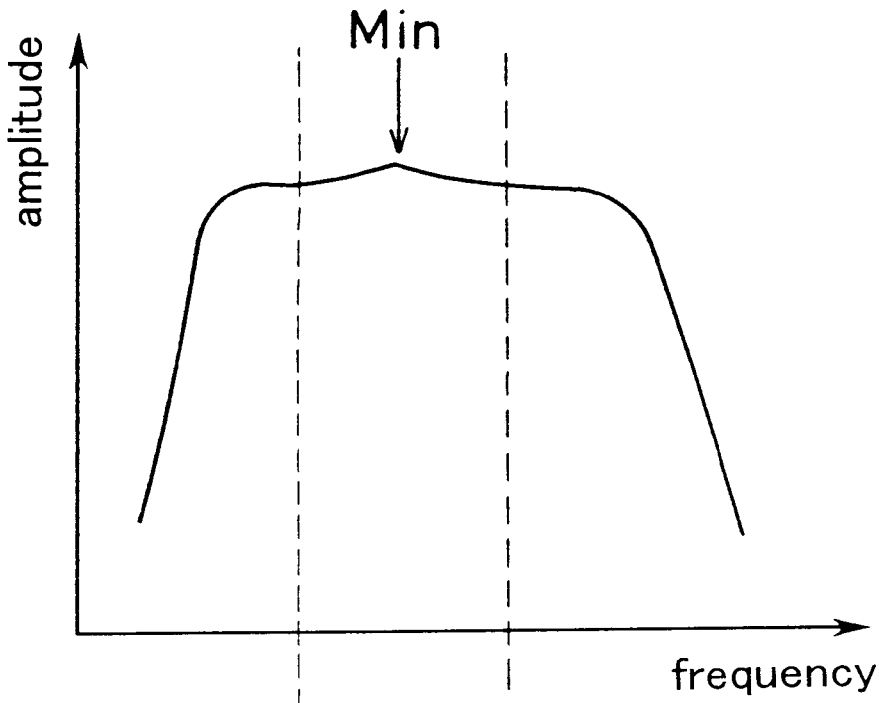
FIG. 7A is a graph showing transfer characteristics in one example of regulation of the dielectric filter according to the first embodiment of the present invention.
Figure 7B:
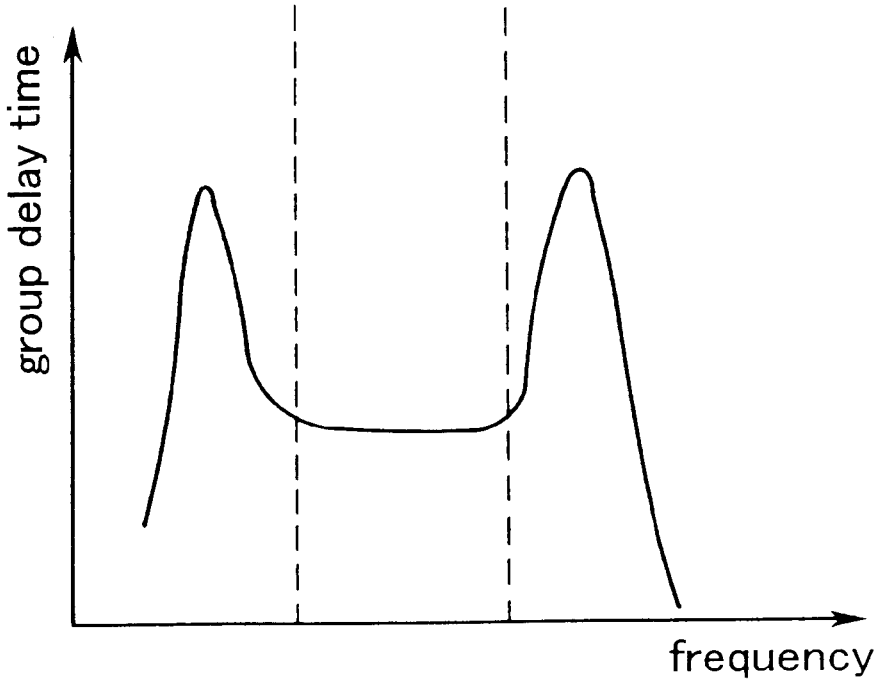
FIG. 7B is a graph showing group delay frequency characteristics in the same regulation example.

By regulating the resonance frequencies of the respective resonators and the values of coupling capacitors according to the above-mentioned configuration, the minimum of the insertion loss within the passband in the amplitude transfer characteristics can be obtained within a uniform-group-delay frequency band as shown in FIG. 7A. Therefore, further excellent characteristics desirable for a delay device can be obtained, thus obtaining a filter that can be produced and regulated easily and has a good balance between the amplitude characteristics and the delay characteristics.

Figure 8A:
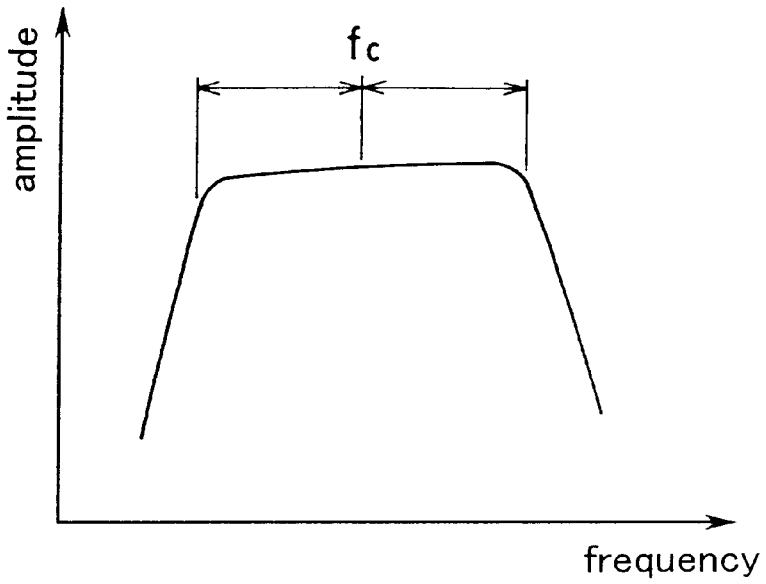
FIG. 8A is a graph showing transfer characteristics in another example of regulation of the dielectric filter according to the first embodiment of the present invention.
Figure 8B:
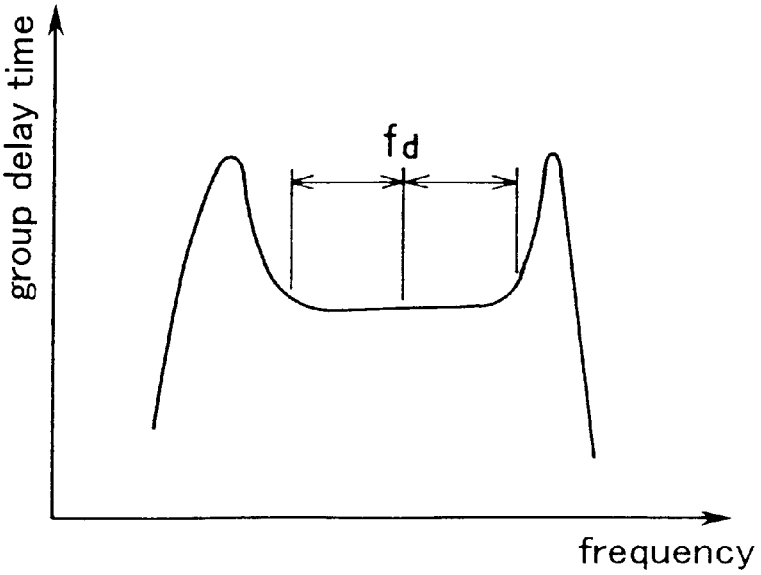
FIG. 8B is a graph showing group delay frequency characteristics in the same regulation example.

As shown in FIGS. 8A and 8B, it is possible to obtain the characteristics in which the uniform-group-delay frequency band is within the passband in the amplitude transfer characteristics and the center frequency fd of the uniform-group-delay frequency band is higher than the center frequency fc of the passband in the amplitude transfer characteristics. This enables further excellent characteristics desirable for a delay device to be obtained, thus obtaining a filter that can be produced and regulated easily and has a good balance between the amplitude characteristics and the delay characteristics.

Figure 9A:
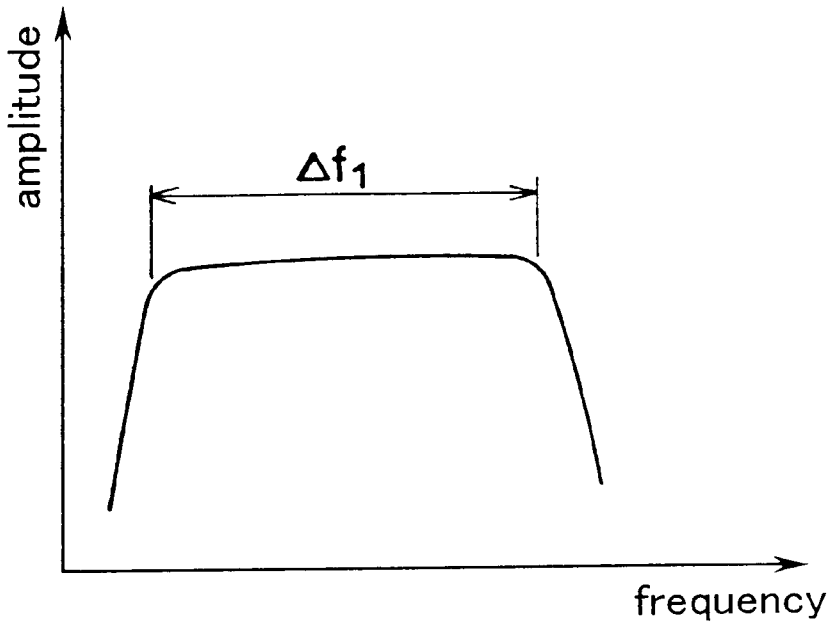
FIG. 9A is a graph showing transfer characteristics in a further example of regulation of the dielectric filter according to the first embodiment of the present invention.
Figure 9B:
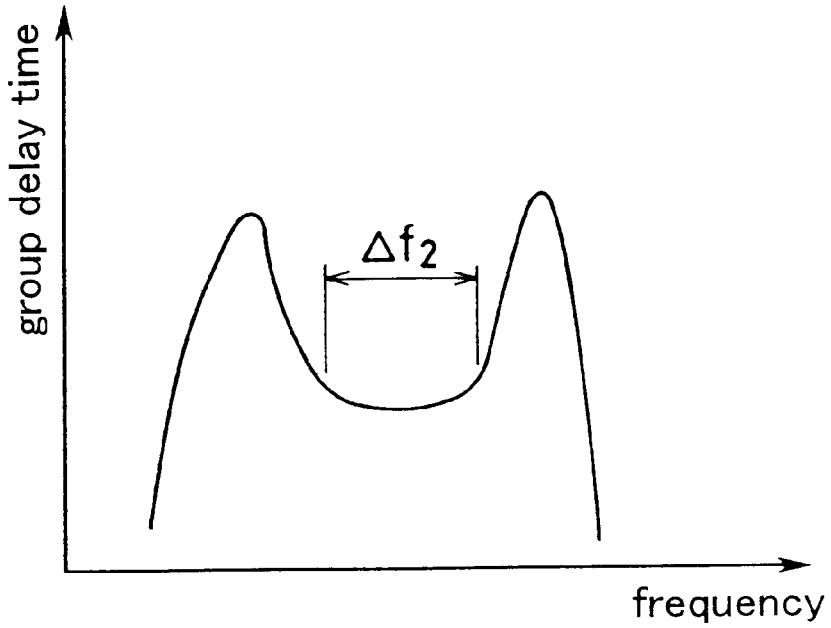
FIG. 9B is a graph showing group delay frequency characteristics in the same regulation example.

As shown in FIGS. 9A and 9B, the following characteristics can be obtained. That is, the passband width Δf1 in the amplitude transfer characteristics has a band width at least twice as wide as the uniform-group-delay frequency band width Δf2. This enables further excellent characteristics desirable for a delay device to be obtained, thus obtaining a filter that can be produced and regulated easily and has a good balance between the amplitude characteristics and the delay characteristics.

Figure 10A:
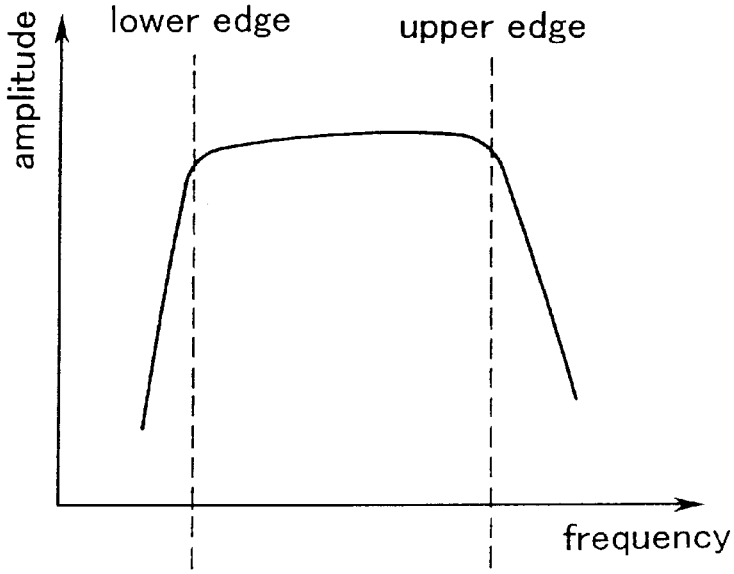
FIG. 10A is a graph showing transfer characteristics in still another example of regulation of the dielectric filter according to the first embodiment of the present invention.
Figure 10B:
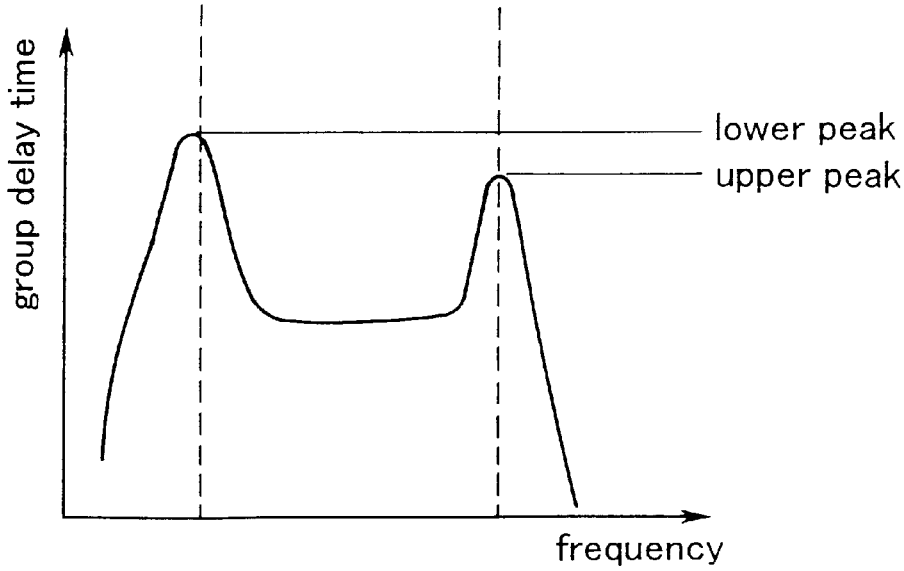
FIG. 10B is a graph showing group delay frequency characteristics in the same regulation example.

Similarly, as shown in FIGS. 10A and 10B, the following characteristics can be obtained. In the frequency characteristics of a group delay time, peak values of the group delay time are obtained at both edges of the passband in the amplitude transfer characteristics. In addition, the peak value at the lower edge of the passband in the amplitude transfer characteristics is larger than that at the upper edge. This enables further excellent characteristics desirable for a delay device to be obtained, thus obtaining a filter that can be produced and regulated easily and has a good balance between the amplitude characteristics and the delay characteristics.

Figure 11A:
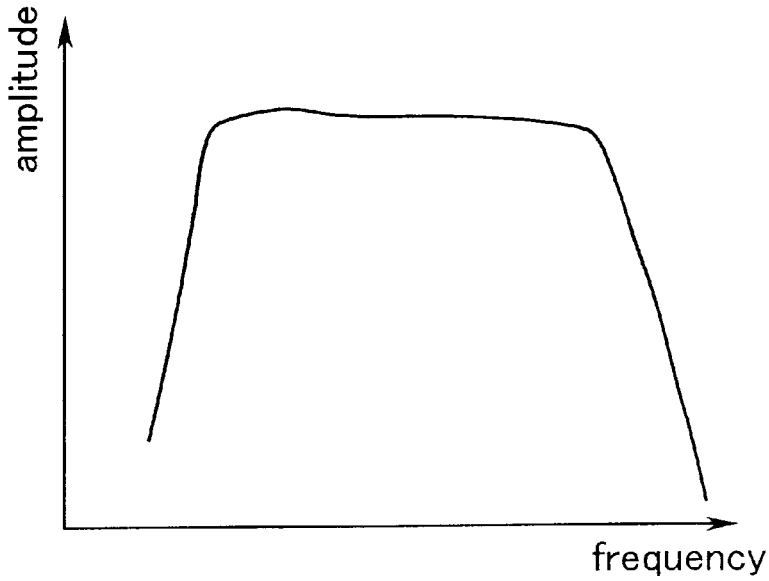
FIG. 11A is a graph showing transfer characteristics in yet another example of regulation of the dielectric filter according to the first embodiment of the present invention.
Figure 11B:
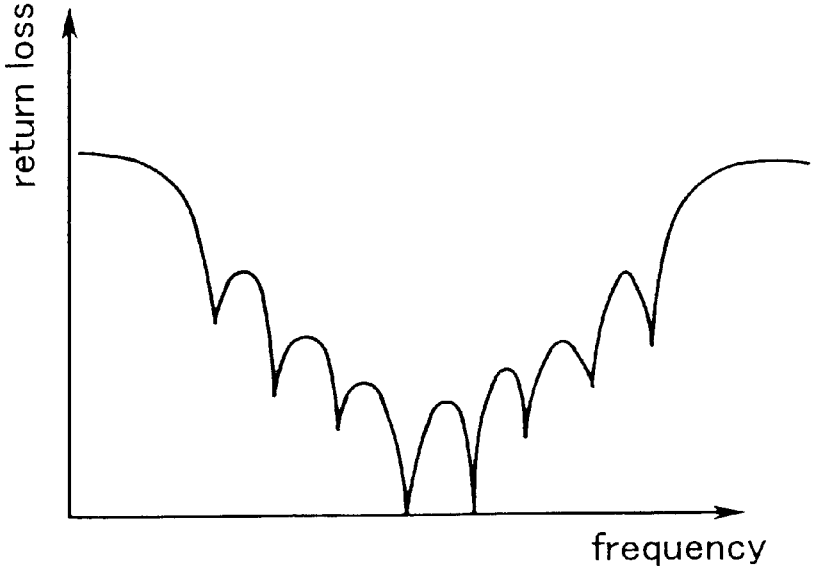
FIG. 11B is a graph showing return loss characteristics in the same regulation example.

Further, as shown in FIGS. 11A and 11B, the following characteristics can be obtained. That is, a return loss within a uniform-group-delay frequency band has a ripple and the minimum of the ripple is larger than that of the ripple in a return loss outside the band. In addition, the minimum becomes smaller from the center toward both edges of the passband in the frequency transfer characteristics. This enables further excellent characteristics desirable for a delay device to be obtained, thus obtaining a filter that can be produced and regulated easily and has a good balance between the amplitude characteristics and the delay characteristics.

As the screw tuners 16 and the metal fittings 18 for frequency regulation, examples that are gold-plated and silver-plated were described in the above. However, gold, silver, or copper may be used as their materials, or those plated with gold, silver, or copper also may be used.

SECOND EMBODIMENT

Figure 12:
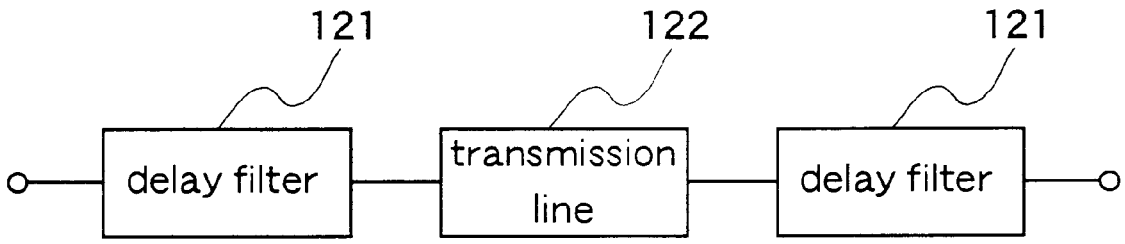
FIG. 12 is a block diagram of a dielectric filter according to a second embodiment of the present invention.

An in-band-flat-group-delay type dielectric filter according to a second embodiment of the present invention is described in detail with reference to the drawings as follows. FIG. 12 is a block diagram of the in-band-flat-group-delay type dielectric filter according to the second embodiment of the present invention. Dielectric filters 121 have the same configuration as that of the in-band-flat-group-delay type dielectric filter according to the first embodiment. In this embodiment, two dielectric filters 121 are connected with a transmission line 122.

Figure 13A:
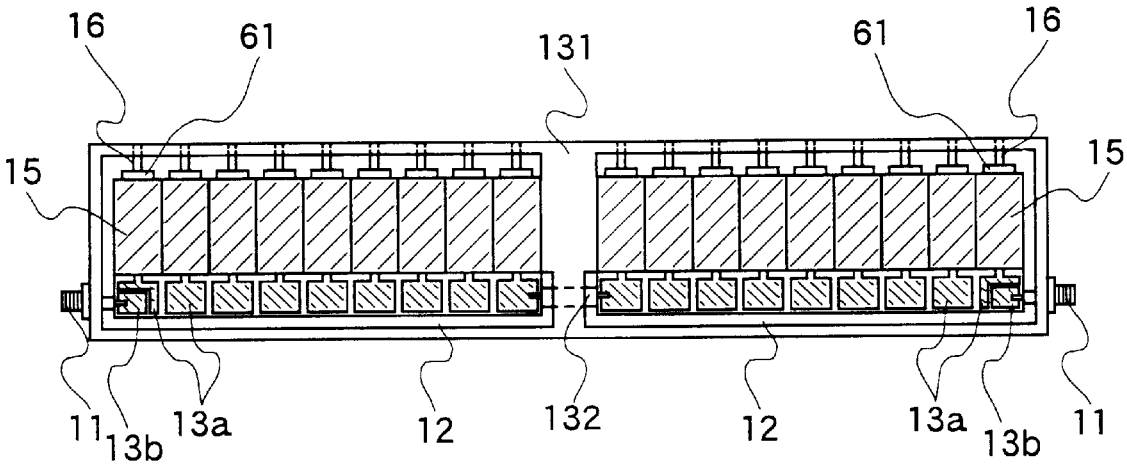
FIG. 13A is a plan view showing the dielectric filter according to the second embodiment of the present invention, which is shown with an upper wall of its case being removed.
Figure 13B:
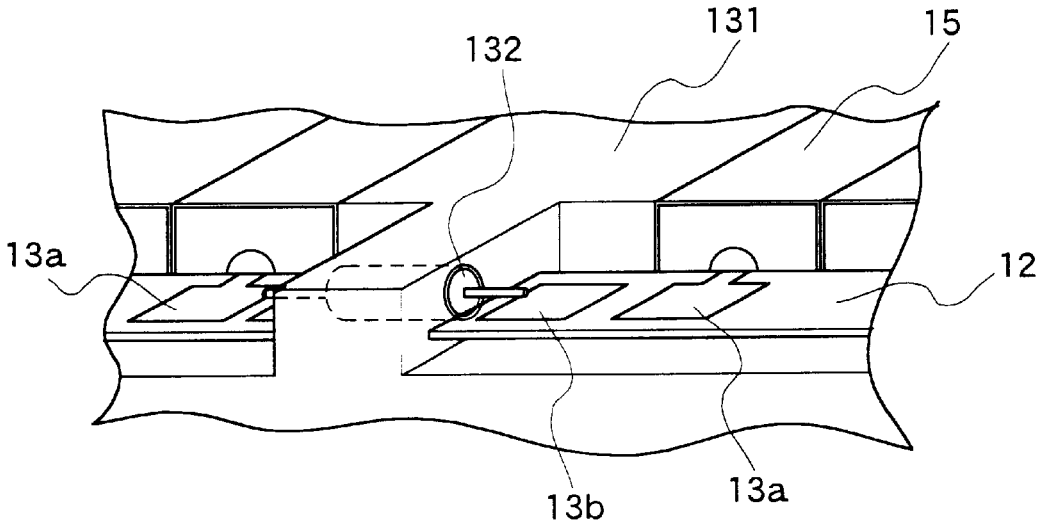
FIG. 13B is a partial enlarged perspective view of the same.

FIG. 13A shows the inside of an in-band-flat-group-delay type dielectric filter obtained by implementing the configuration illustrated by the block diagram shown in FIG. 12 as a practical device, with an upper wall of its case being removed. Numeral 131 indicates a case, and numeral 132 a semi-rigid cable. This semi-rigid cable 132 is used as the transmission line 122 shown in FIG. 12. FIG. 13B is a partial enlarged perspective view showing a portion including the semi-rigid cable 132 shown in FIG. 13A.

The case 131 is formed of metal walls surrounding the dielectric filters 121 separated by the semi-rigid cable 132 so as to shield the dielectric filters 121 individually. The semi-rigid cable 132 has a characteristic impedance whose value is the same as that of the input/output impedance of the dielectric filters 121.

With respect to the dielectric filter with the configuration as described above, its operation is described as follows.

Figure 14:
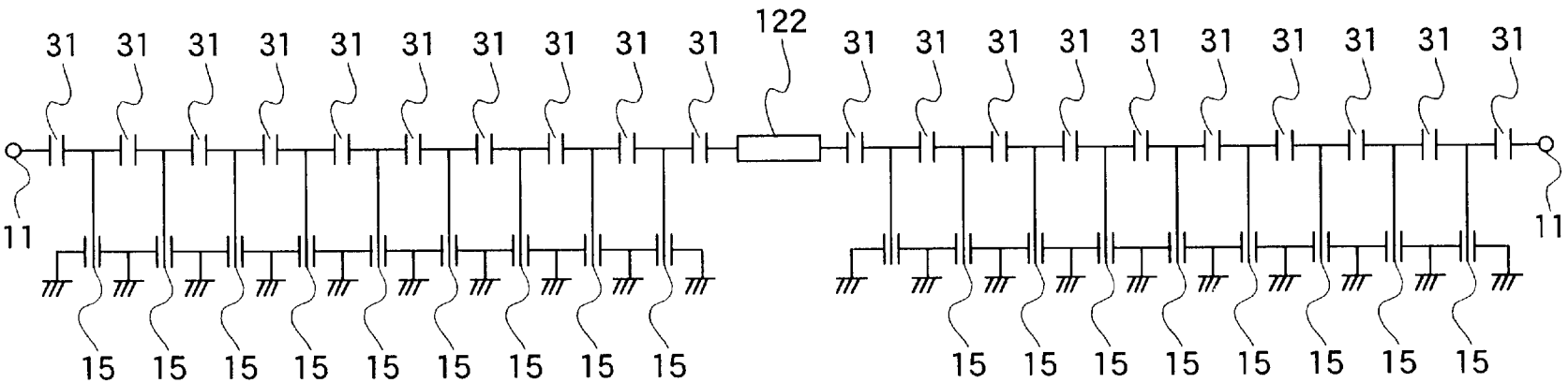
FIG. 14 is a schematic diagram of an equivalent circuit of the dielectric filter shown in FIGS. 13A and 13B.

FIG. 14 is a schematic diagram of an equivalent circuit of the in-band-flat-group-delay type dielectric filters according to the second embodiment shown in FIGS. 12, 13A and 13B. In FIG. 14, parts corresponding to those in FIGS. 12, 13A and 13B are indicated by the same numbers as in FIGS. 12, 13A and 13B. Numeral 31 indicates coupling capacitors formed of the electrodes 13 shown in FIGS. 13A and 13B. In this way, dielectric resonators 15 are coupled with the coupling capacitors 31, thus obtaining a multistage bandpass filter.

As described above, a plurality of filter blocks are cascaded with the transmission line having a characteristic impedance whose value is the same as that of the input/output impedance, and thus the respective filters can be regulated separately. Similarly in this embodiment, modified examples with various configurations described in the first embodiment can be applied, and the characteristics shown in FIGS. 4 and 7 to 11 obtained thereby also can be obtained. Thus, the regulation of the whole becomes very easy and the group delay time in the whole can be increased.

THIRD EMBODIMENT

A linearized amplifier according to a third embodiment of the present invention is described in detail with reference to the drawings as follows.

Figure 15:
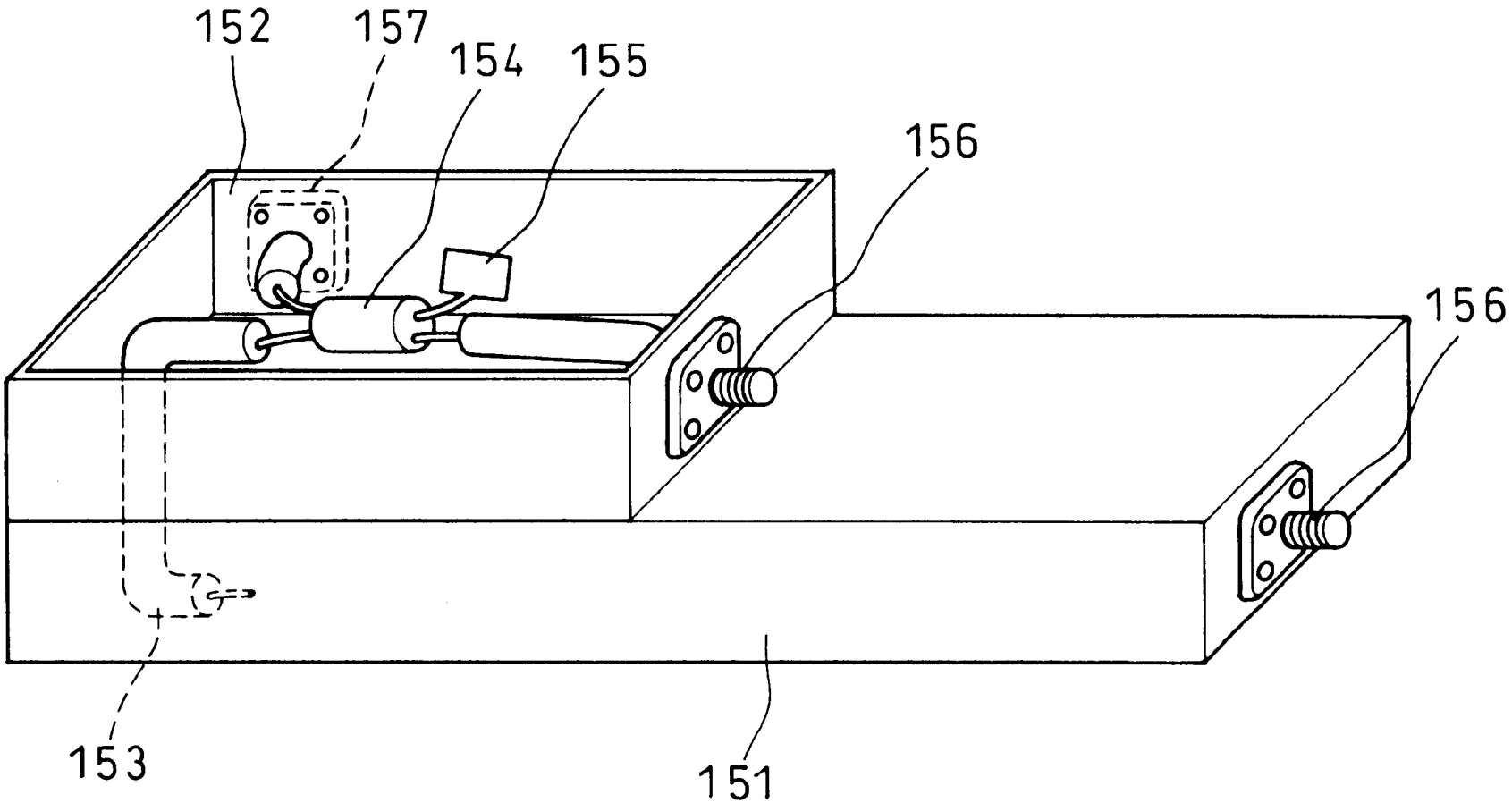
FIG. 15 is a perspective view of a dielectric filter included, as a part, in a feedforward amplifier according to a third embodiment of the present invention.
Figure 32:
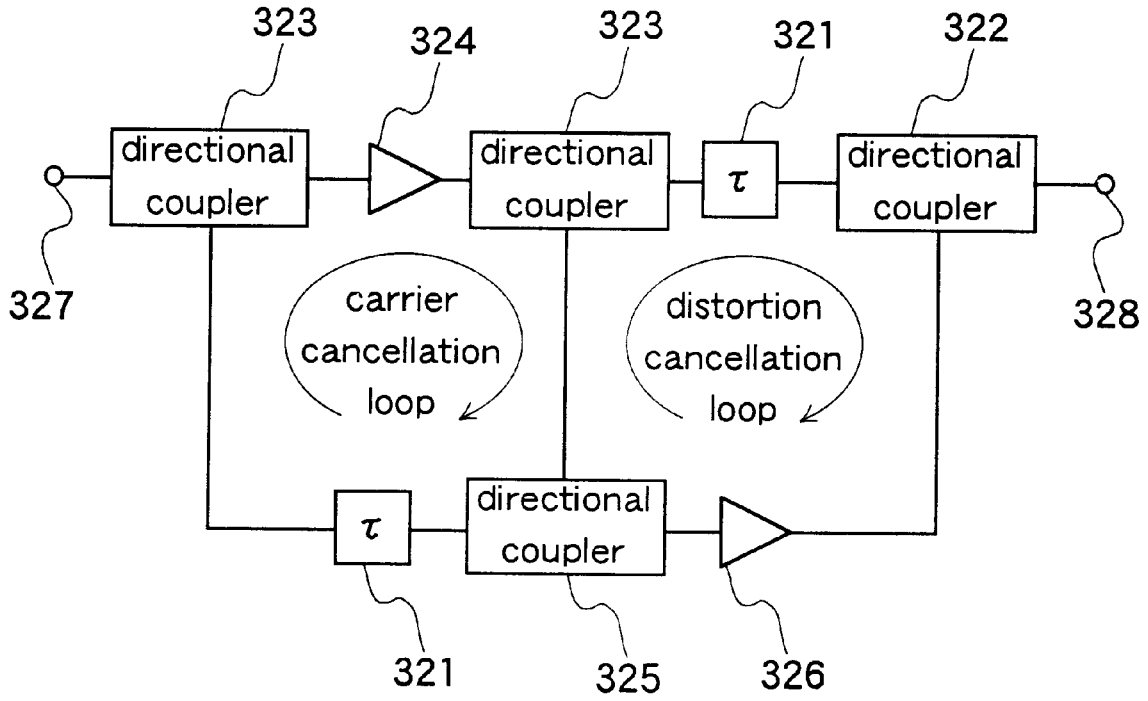
FIG. 32 PRIOR ART
FIG. 32 is a block diagram of a conventional feedforward amplifier.

FIG. 15 is a perspective view showing the configuration of a part of a linearized amplifier, in which a dielectric filter 151 of the present invention is used as a delay circuit 321 included in the feedforward amplifier shown in FIG. 32 and a directional coupler 152 is used as the directional coupler 322 included in the feedforward amplifier shown in FIG. 32, which are combined to form one body. Numeral 153 denotes a transmission line, numeral 154 a quarter-wave transmission line, numeral 155 a termination, numeral 156 input/output connectors, and numeral 157 a directional coupling connector. The dielectric filter 151 and the directional coupler 152 are combined via the transmission line 153 to form one body. The configuration of the dielectric filter 151 may be the same as those of the above-mentioned embodiments and therefore is not shown in the figure.

The delay circuits 321 shown in FIG. 32 are required to have group delay times equal to that of the main amplifier 324 or the auxiliary amplifier 326. Generally, in the amplifiers 324 and 326 included in the feedforward amplifier, the group delay time is at least one nanosecond. Therefore, the group delay times of the dielectric filters 321 also are required to be at least one nanosecond.

In the feedforward amplifier, it is required to equalize group delay times strictly in the two paths and at the same time, small deviations in group delay time and in phase within a frequency band, i.e. flat characteristics, are required. In the present embodiment, practically satisfactory results were obtained when the deviations in group delay time and in phase are within ranges of ±10.5 ns and ±0.5°. These numbers depend on the circuit and system of the amplifier. When the deviations are reduced to obtain the flat characteristics, the regulation difficulty increases and the increase in number of stages of the dielectric resonators may be required in some cases.

When the in-band-flat-group-delay type dielectric filter according to the first or second embodiment is used as the delay circuit 321 in the distortion cancellation loop, signals are amplified in the amplifier and then the signals thus amplified are input into the filter. Therefore, a great effect of increasing the efficiency is obtained due to the decrease in loss. In addition, when the uniform-group-delay frequency band width in the dielectric filter is at least three times as wide as a required band width of the amplifier, the intermodulation distortion of third order or higher in the amplifier can be compensated, thus obtaining an amplifier causing a low distortion.

The same effect also can be obtained when a dielectric filter of the present invention is used as the delay circuit 321 in the carrier cancellation loop.

In the above-mentioned embodiment, capacitors are used for coupling the plurality of dielectric coaxial resonators. However, inductors or a coupling circuit formed of a combination of capacitors and inductors also can be used.

FOURTH EMBODIMENT

Figure 16:
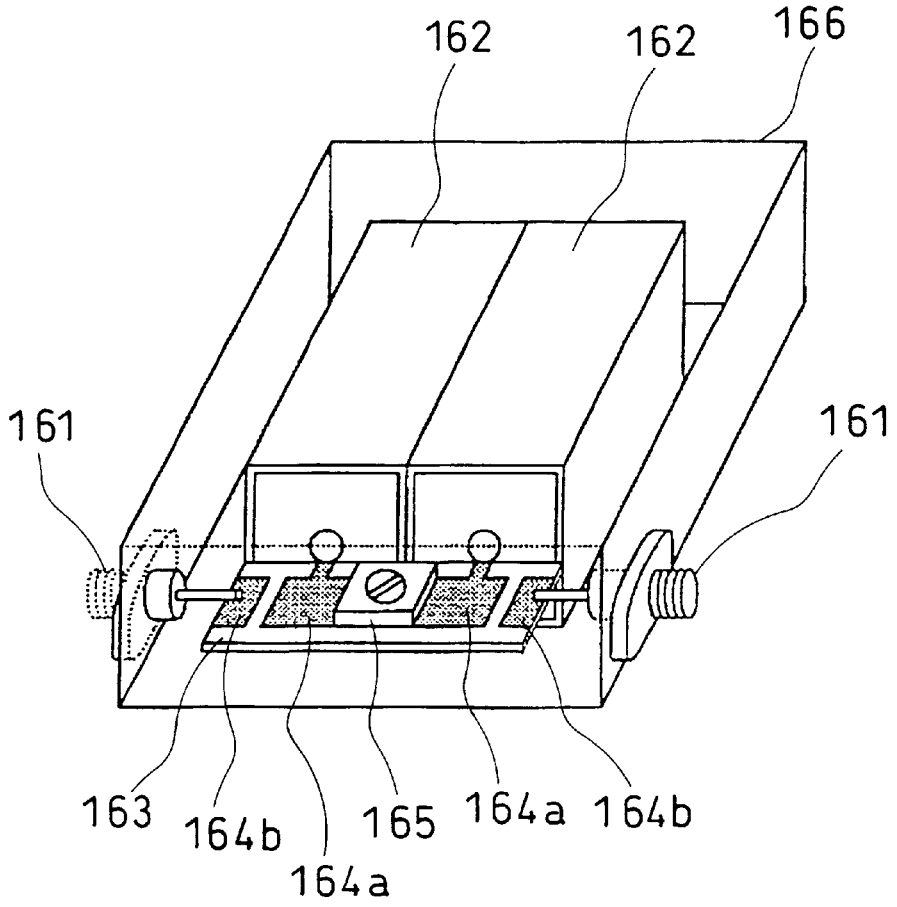
FIG. 16 is a perspective view of a dielectric filter according to a fourth embodiment of the present invention, which is shown with an upper wall and a part of side walls of its case being removed.

FIG. 16 shows the inside of a dielectric filter according to a fourth embodiment of the present invention, with an upper wall and a part of side walls of its case being removed. In FIG. 16, numeral 161 indicates input/output terminals, numeral 162 dielectric coaxial resonators, numeral 163 an alumina coupling board, numerals 164*a* and 164*b* copper-plated electrodes forming coupling capacitors, numeral 165 a trimmer capacitor, and numeral 166 a case.

The end faces of the dielectric coaxial resonators 162 are aligned and their respective external conductors are grounded to the case 166. Internal conductors of the dielectric coaxial resonators 162 are electrically connected to the copper-plated electrodes 164*a* with solder or the like, respectively. Between the copper-plated electrodes 164*a* connected to the internal conductors of the dielectric coaxial resonators 162, the trimmer capacitor 165 is connected. The copper-plated electrodes 164*b* at both ends of the alumina coupling board 163 are connected to internal conductors of the input/output terminals 161.

With respect to the dielectric filter with the configuration as described above, its operation is described as follows.

Figure 17:
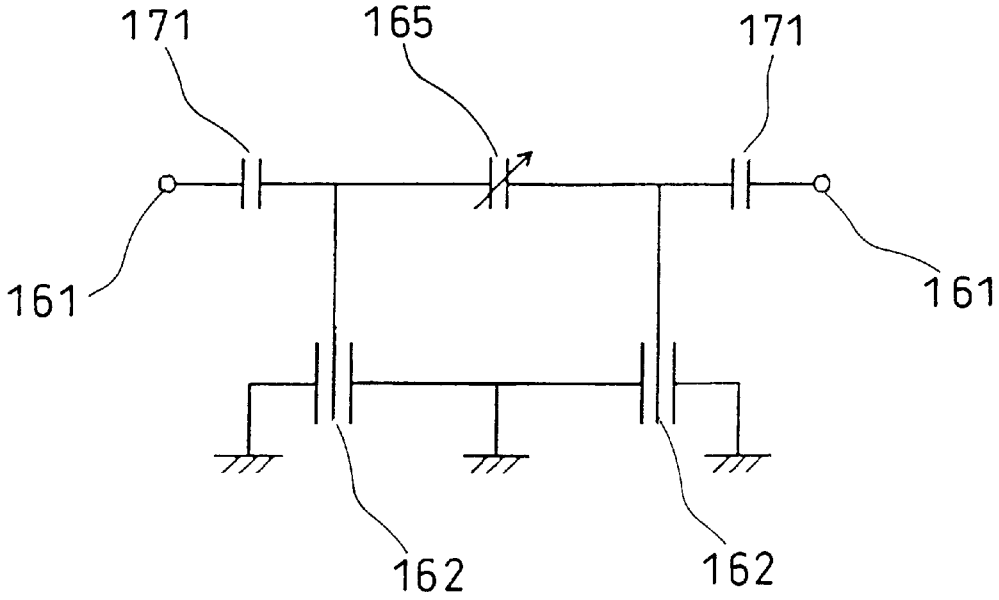
FIG. 17 is a schematic diagram of an equivalent circuit of the dielectric filter shown in FIG. 16.

FIG. 17 is a schematic diagram of an equivalent circuit of the dielectric filter according to the fourth embodiment of the present invention. In FIG. 17, the same parts as those in FIG. 16 are indicated by the same numbers as in FIG. 16. Numeral 171 indicates coupling capacitors on the input/output sides formed by the copper-plated electrodes 164*b* shown in FIG. 16. In this way, the dielectric coaxial resonators 162 are coupled with the coupling capacitors 171, respectively, thus obtaining a bandpass filter.

Figure 18:
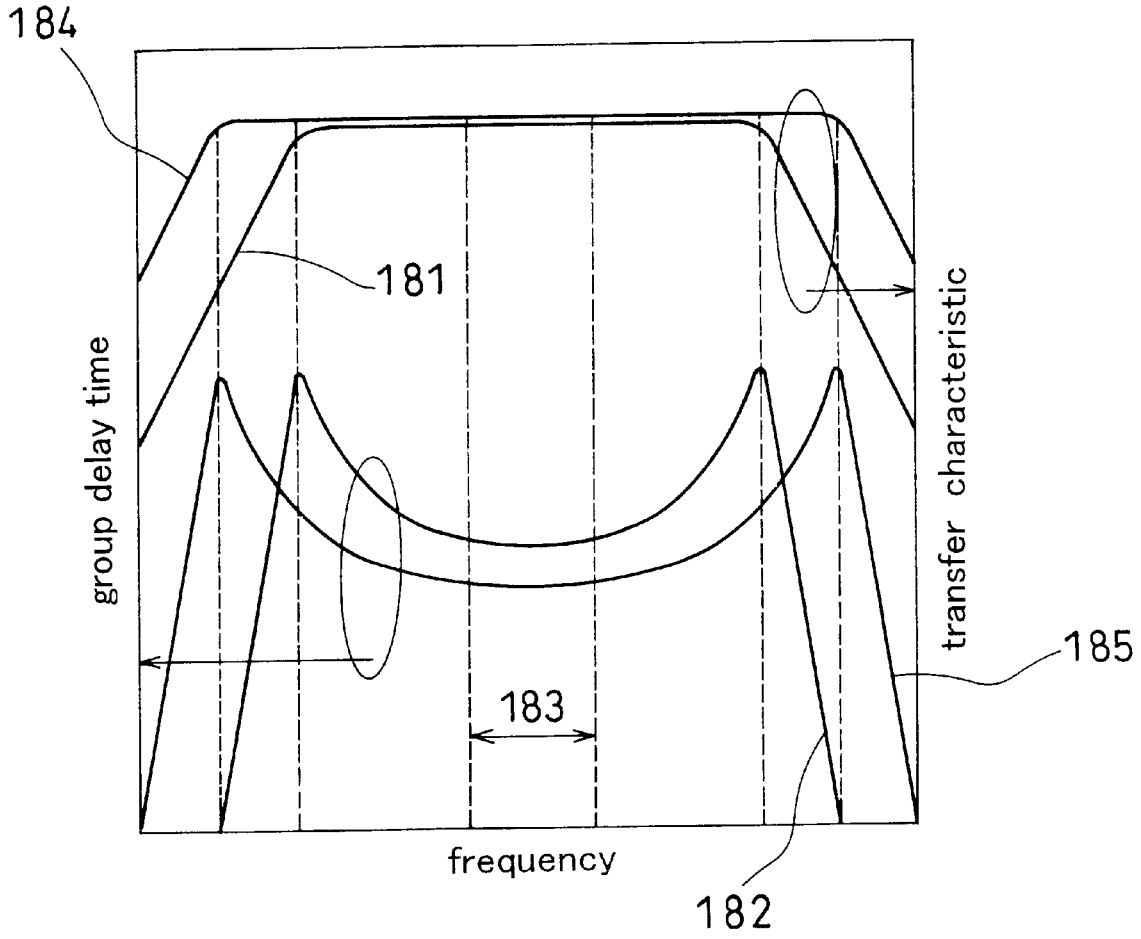
FIG. 18 is a graph showing transfer characteristics and group delay time of the dielectric filters according to the fourth embodiment and a fifth embodiment of the present invention.

FIG. 18 shows transfer characteristics of the filter when the inter-stage trimmer capacitor 165 is varied. In this way, when the trimmer capacitor 165 is varied, the passband width in the filter varies, thus varying the group delay time accordingly.

As can been seen from FIG. 18, the peaks of the group delay time indicated by the curved line 182 are in the vicinities of the edges of the passband in the transfer characteristics indicated by the curved line 181. Within a desired band width 183 between the peaks, the group delay time is substantially flat at smaller values than those at the peaks. The transfer characteristics when the passband is broadened is indicated by the curved line 184 and the group delay time in this case is indicated by the curved line 185. When the passband is broadened, the interval between the peaks of the group delay time also is widened and the flat group delay time within the desired band width 183 is decreased, thus reducing the group delay time.

As described above, by varying the trimmer capacitor 165 between the dielectric coaxial resonators 162, the passband can be broadened or narrowed, and thus the group delay time can be varied.

FIFTH EMBODIMENT

A dielectric filter according to fifth embodiment of the present invention is described with reference to the drawings as follows.

Figure 19:
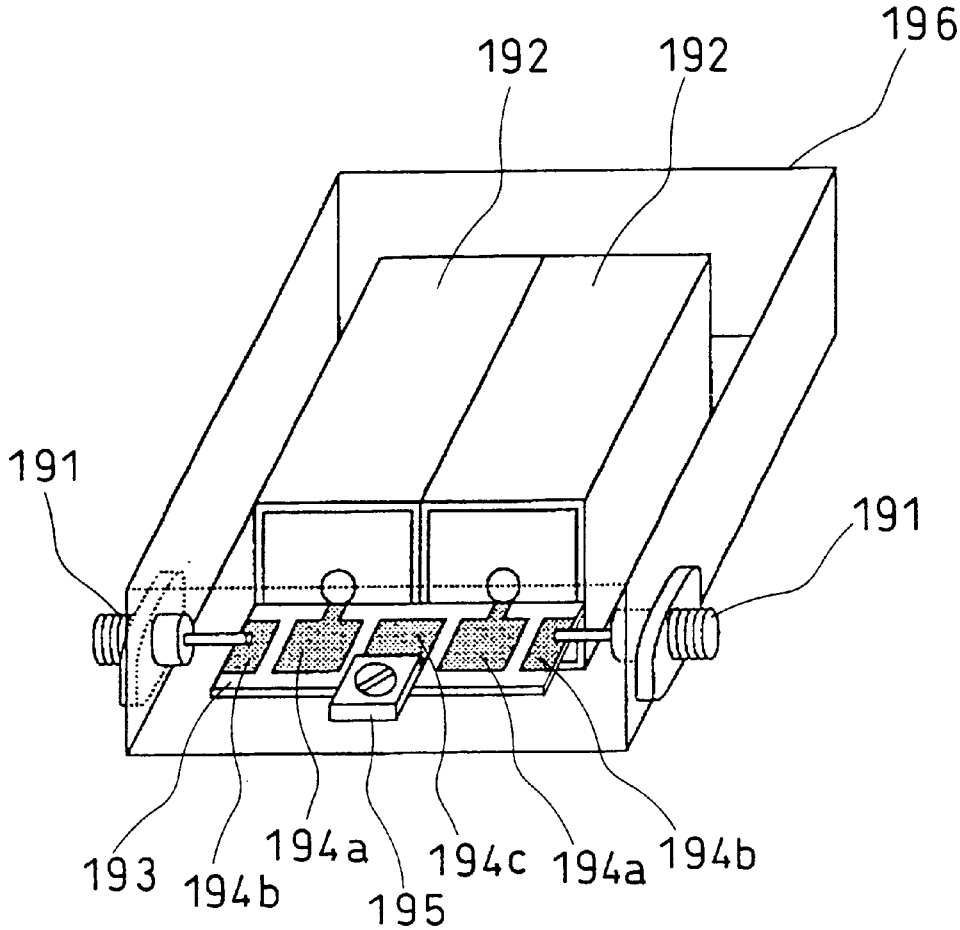
FIG. 19 is a perspective view of the dielectric filter according to the fifth embodiment of the present invention, which is shown with an upper wall and a part of side walls of its case being removed.

FIG. 19 shows the inside of a dielectric filter according to the fifth embodiment of the present invention, with an upper wall and a part of side walls of its case being removed. In FIG. 19, numeral 191 denotes input/output terminals, numeral 192 dielectric coaxial resonators, numeral 193 an alumina coupling board, numeral 194*a* and 194*b* copper-plated electrodes forming coupling capacitors, numeral 195 a trimmer capacitor, and numeral 196 a case.

The end faces of the dielectric coaxial resonators 192 are aligned and their respective external conductors are grounded to the case 196. Internal conductors of the dielectric coaxial resonators 192 are electrically connected to the copper-plated electrodes 194*a* with solder or the like, respectively. Between a ground and a copper-plated electrode 194*c* positioned between the copper-plated electrodes 194*a* connected to the internal conductors of the dielectric coaxial resonators 192, the trimmer capacitor 195 is connected. The copper-plated electrodes 194*b* at both ends of the alumina coupling board 193 are connected to internal conductors of the input/output terminals 191.

With respect to the dielectric filter with the configuration as described above, its operation is described as follows.

Figure 20:
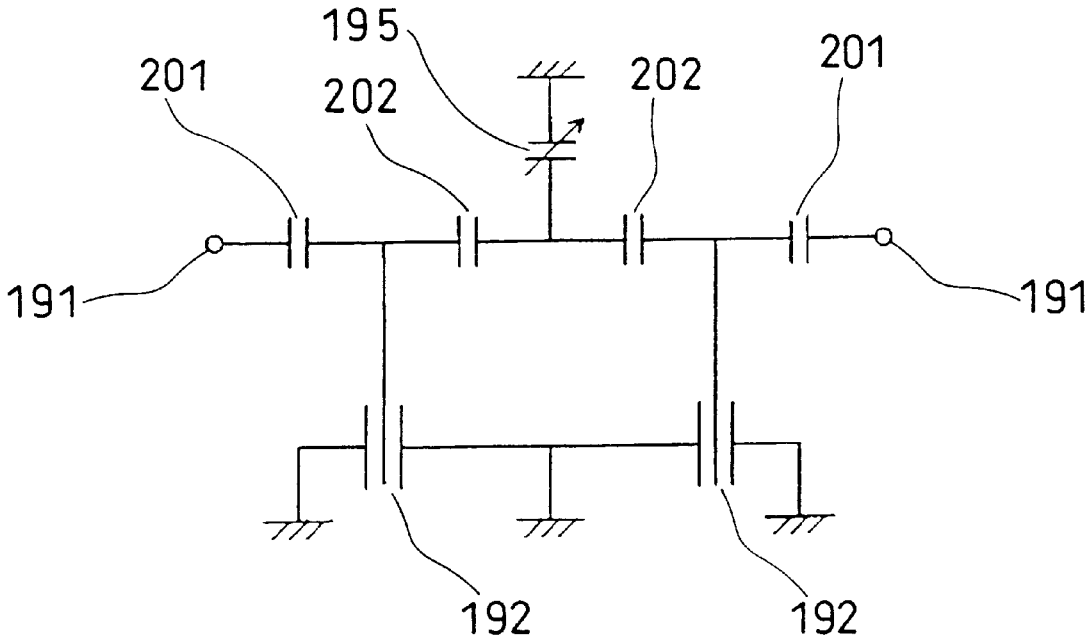
FIG. 20 is a schematic diagram of an equivalent circuit of the dielectric filter shown in FIG. 19.

FIG. 20 is a schematic diagram of an equivalent circuit of the dielectric filter according to the fifth embodiment of the present invention. In FIG. 20, the same parts as those in FIG. 19 are indicated by the same numbers as in FIG. 19. Numeral 201 indicates coupling capacitors on the input/output sides, which are formed of the copper-plated electrodes 194*b* positioned at both ends of the alumina coupling board 193 and the copper-plated electrodes 194*a* connected to the inner conductors of the dielectric coaxial resonators 192. Numeral 202 denotes inter-stage coupling capacitors formed of the copper-plated electrodes 194*a* connected to the internal conductors of the dielectric coaxial resonators 192 and the copper-plated electrode 194*c* connected to the trimmer capacitor 195. In this way, the dielectric coaxial resonators 192 are coupled with the coupling capacitors 201 on the input/output sides and the inter-stage coupling capacitors 202, respectively, thus obtaining a bandpass filter.

Figure 21:
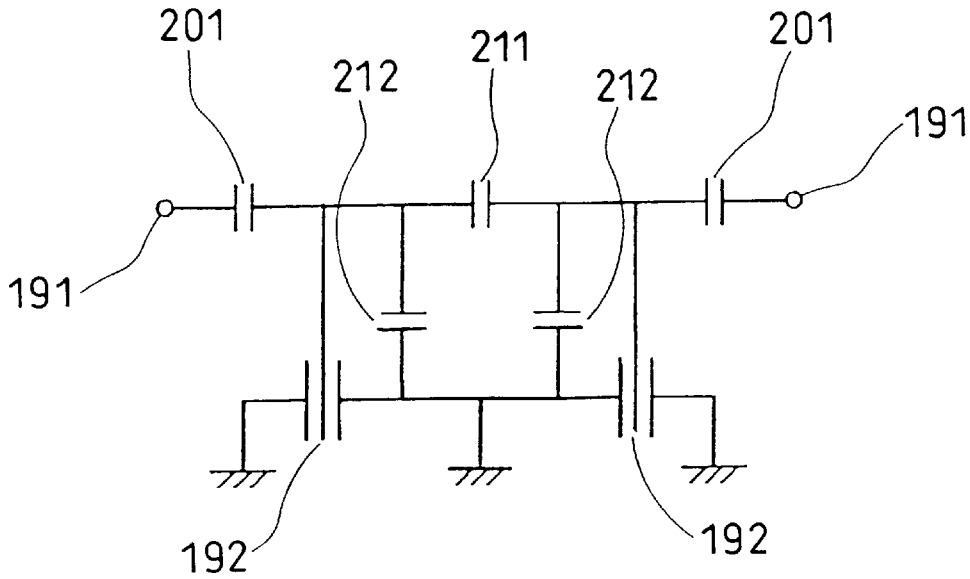
FIG. 21 is a schematic diagram of an equivalent circuit in which a T-type connection of a trimmer capacitor and a coupling capacitor formed between dielectric coaxial resonators of the dielectric filter according to the fifth embodiment of the present invention is transformed to a Π-type connection.

The T-type circuit, as shown in FIG. 20, of the trimmer capacitor 195 connected to a ground from a portion between the coupling capacitors 202 can be transformed into a Π-type circuit as shown in FIG. 21 by a transformation of the equivalent circuit. The capacitance value Cl of the inter-stage capacitor 211 shown in FIG. 21 can be expressed by the following formula:

$$C1=(Cb)^2/(Ca+2C),$$

wherein Ca represents a capacitance value of the trimmer capacitor 195 and Cb a capacitance value of the inter-stage coupling capacitors 202 shown in FIG. 20. This means that by varying the trimmer capacitor 195, the inter-stage coupling capacitors are varied. Thus, the group delay time can be varied as in the fourth embodiment.

As described above, according to the present embodiment, by providing a variable capacitor in parallel to the ground from the series capacitors for coupling the dielectric coaxial resonators and allowing the capacitor to be varied, the group delay time can be varied continuously. Even when the variable capacitor is replaced by a variable inductor, the group delay time also can be varied.

Figure 22:
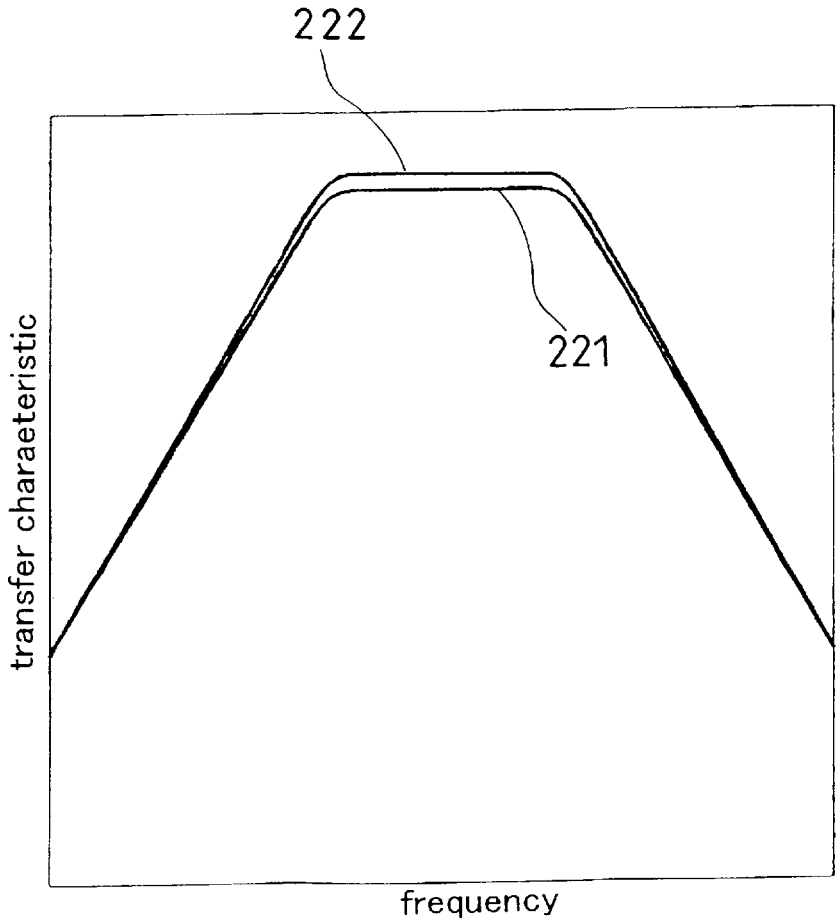
FIG. 22 is a graph showing transfer characteristics in the case where Q values of variable capacitors in the dielectric filters according to the fourth and fifth embodiments of the present invention are taken as 100.

FIG. 22 shows the transfer characteristics of the circuits shown in FIGS. 17 and 20 in the case of a variable capacitor with a Q value of 100, which indicates the performance of circuit parts, and capacitors other than the variable capacitor with a Q value of 800. The line indicated by numeral 221 shows the characteristics of the circuit shown in FIG. 17 and the line indicated by numeral 222 shows the characteristics of the circuit shown in FIG. 20. By positioning the variable capacitor in parallel, the insertion loss characteristics are not deteriorated greatly even when the Q value of the variable capacitor is low.

Since the group delay time can be varied continuously, in a feedforward circuit of a linearized amplifier or the like, the working efficiency of the regulation is increased, thus improving the productivity and mass-productivity.

Figure 23:
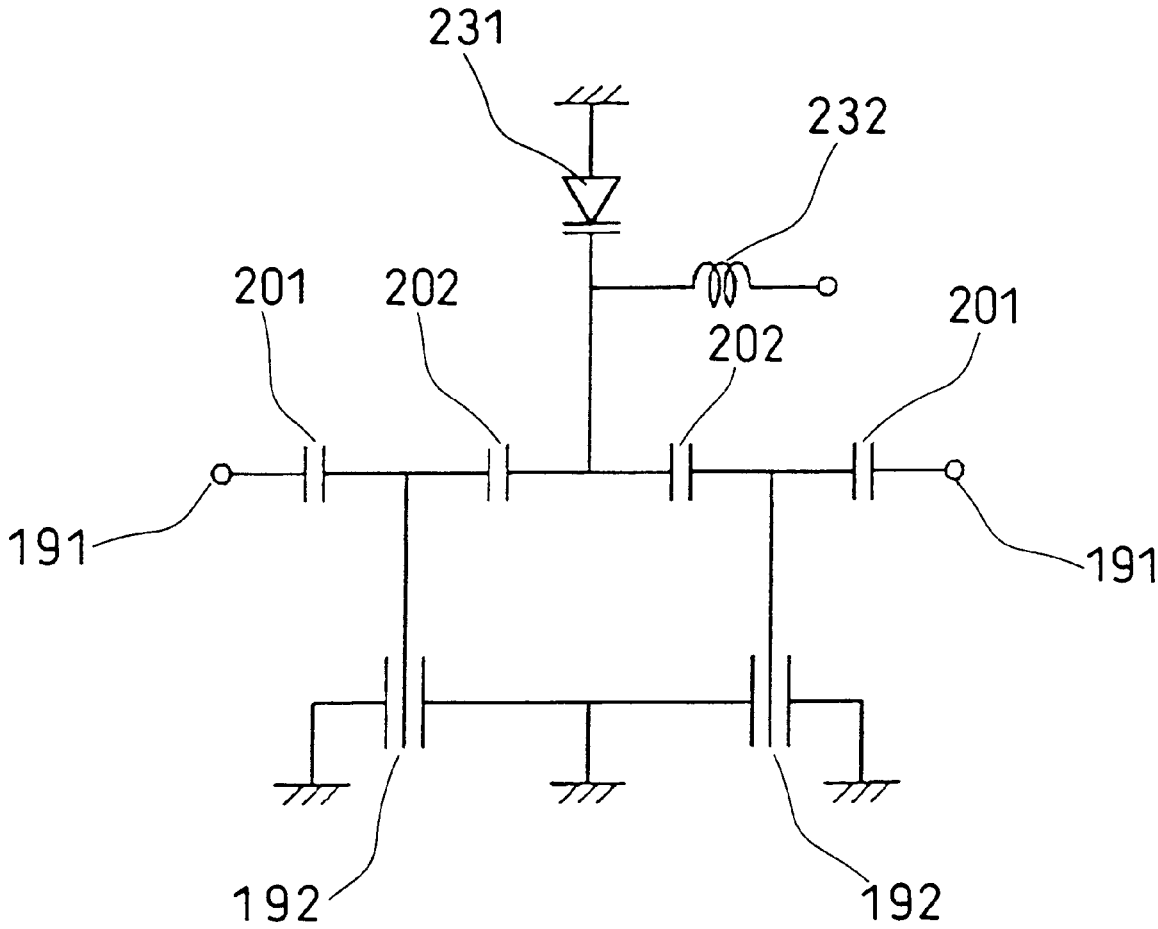
FIG. 23 is a schematic diagram of an equivalent circuit using a varactor diode and a choke coil as a variable capacitor in the dielectric filter according to the fifth embodiment of the present invention.

In the above, the trimmer capacitor was used as the variable capacitor. However, the same effect also can be obtained when, as shown in FIG. 23, a varactor diode 231 is used to vary the voltage applied to a choke coil 232, thus varying the capacitance between a portion between the coupling capacitors 202 and the ground.

SIXTH EMBODIMENT

In the dielectric filter with the above-mentioned configuration, the group delay frequency characteristics has high peaks in the vicinities of the edges of the passband and the band width between the peaks in which the group delay time is uniform is not so wide. Therefore, when a wide band width is desired, the number of stages is increased, thus increasing loss. The dielectric filter according to the present embodiment is characterized in that a number of group delays can be obtained in a desired band width using a small number of stages.

Figure 24:
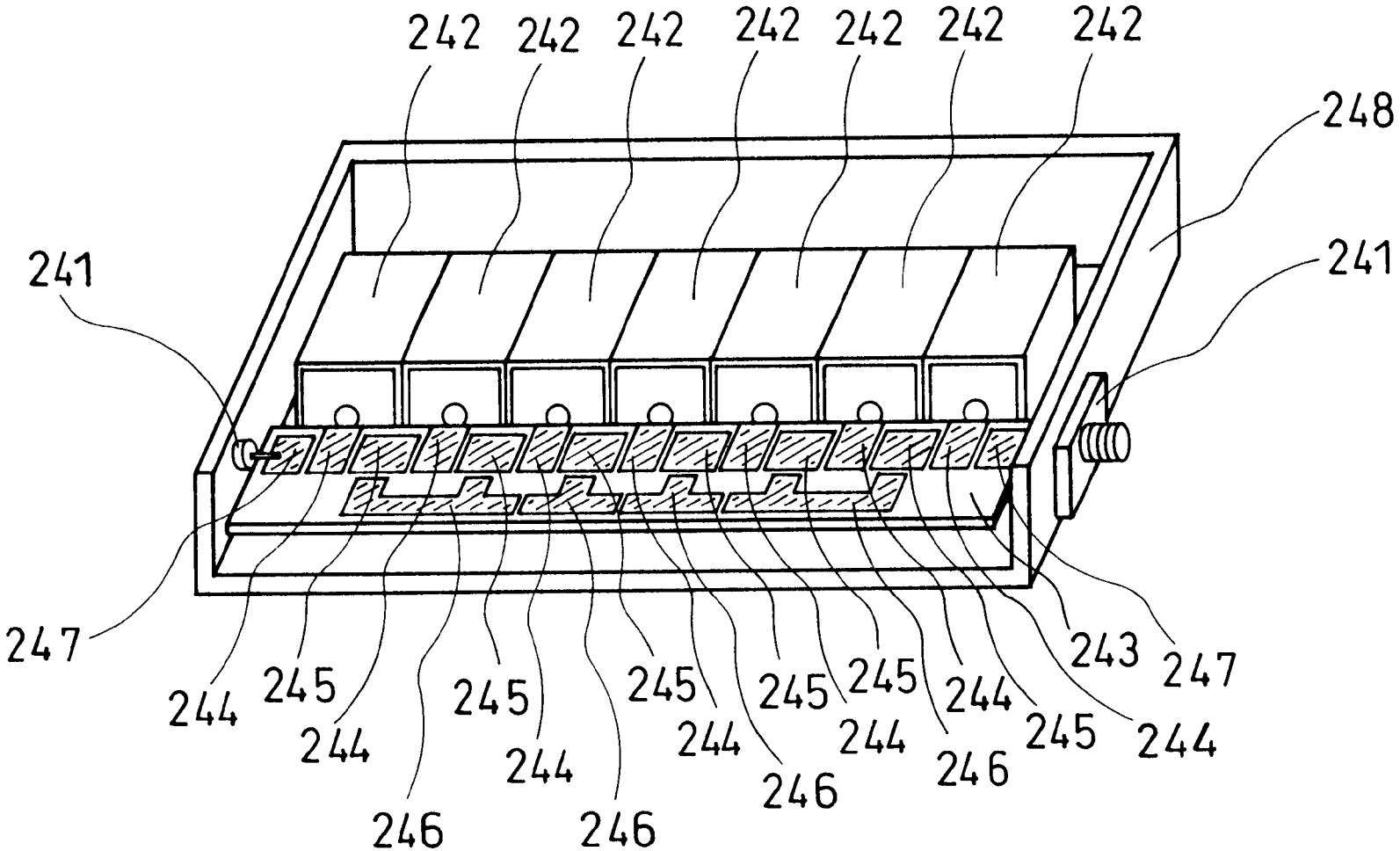
FIG. 24 is a perspective view of a dielectric filter according to a sixth embodiment of the present invention, which is shown with an upper wall and a part of side walls of its case being removed.

FIG. 24 is a perspective view showing a dielectric filter according to a sixth embodiment of the present invention, with its upper cover and a front face of a case 248 being removed. In FIG. 24, numeral 241 indicates input/output terminals, numeral 242 half-wave dielectric resonators with their ends opened, numeral 243 an alumina coupling board, numerals 244 to 247 copper-plated electrodes forming capacitors, and numeral 248 a case. The end faces of the dielectric resonators 242 are aligned and their respective external conductors are grounded to the case 248. The copper-plated electrodes 244 are electrically connected to internal conductors of the dielectric resonators 242 with solder or the like, respectively. The copper-plated electrodes 245 are positioned between the copper-plated electrodes 244 and the copper-plated electrodes 246 are positioned so as to form parallel capacitors with the copper-plated electrodes 245. The copper-plated electrodes 247 positioned outside the copper-plated electrodes 244 at both ends are connected to internal conductors of the input/output terminals 241.

With respect to the dielectric filter with the configuration as described above, its operation is described as follows.

Figure 25:
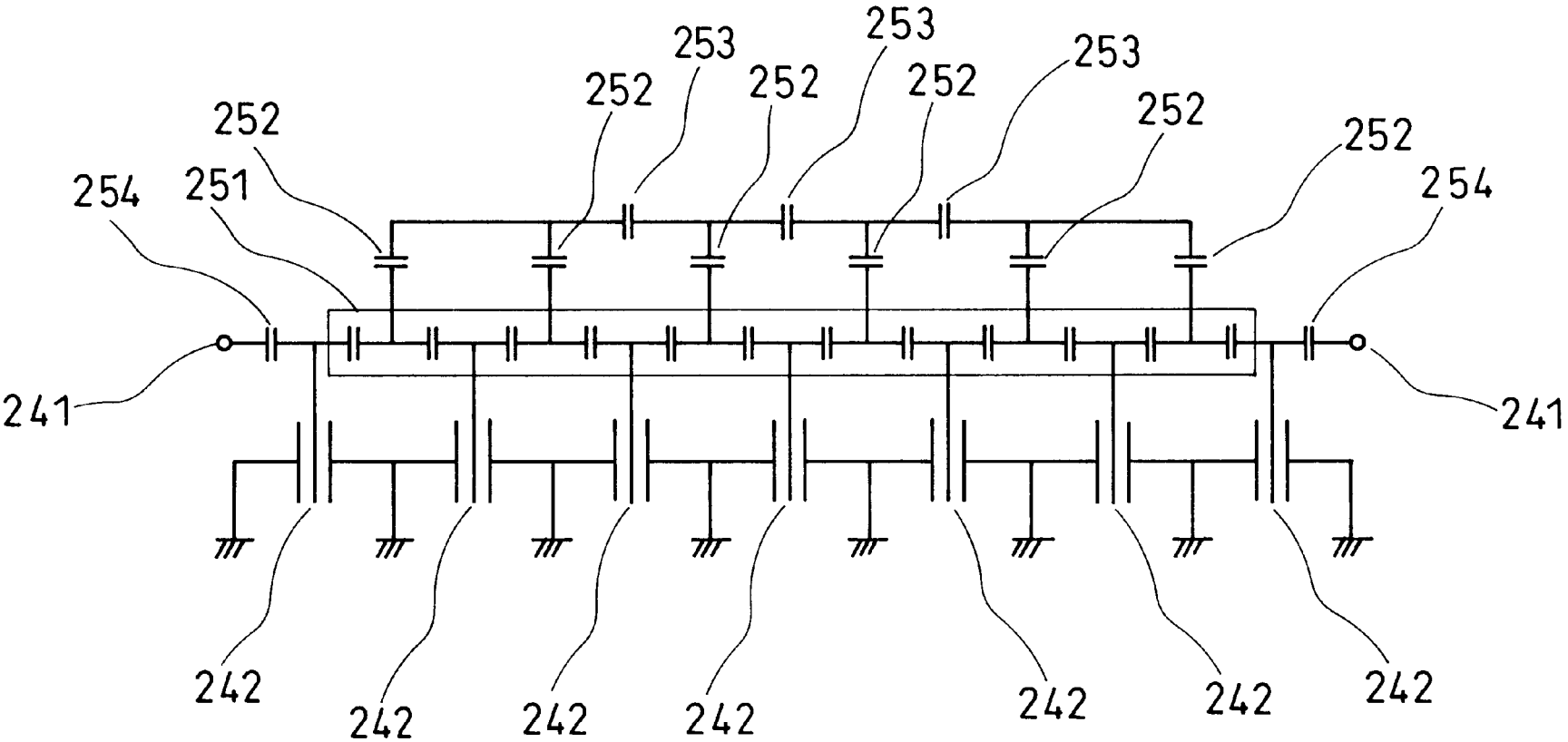
FIG. 25 is a schematic diagram of an equivalent circuit of the dielectric filter shown in FIG. 24.

FIG. 25 is a schematic diagram of an equivalent circuit of the dielectric filter showing the sixth embodiment of the present invention. In FIG. 25, the same parts as those in FIG. 24 are indicated with the same numbers as in FIG. 24. Numeral 251 indicates inter-stage coupling capacitors formed of the copper-plated electrodes 244 and the copper-plated electrodes 245 shown in FIG. 24. Numeral 252 denotes parallel bypass capacitors formed of the copper-plated electrodes 245 and the copper-plated electrodes 246. Numeral 253 indicates series bypass capacitors formed between the respective copper-plated electrodes 246. Numeral 254 denotes input/output capacitors formed of the copper-plated electrodes 244 and the copper-plated electrodes 247.

As is apparent from the above description, in this specification, for example, in FIG. 25, the coupling capacitors between the dielectric resonators 242 are referred to as "inter-stage coupling capacitors". Similarly, the coupling capacitors between the dielectric resonators 242 at both ends and the input/output terminals 241, respectively, are referred to as "input/output capacitors". Furthermore, the capacitors connected from portions between the coupling capacitors (including inter-stage coupling capacitors and input/output capacitors) to portions between the other coupling capacitors are referred to as "bypass coupling capacitors". Particularly, the bypass coupling capacitors arranged in parallel directly from portions between the coupling capacitors are referred to as "parallel bypass capacitors" and the capacitors connecting the respective parallel bypass capacitors as "series bypass capacitors". Moreover, the coupling via a bypass coupling capacitor is referred to as "bypass coupling".

As shown in FIG. 25, the dielectric resonators 242 are connected in parallel to a main line formed of the inter-stage coupling capacitors 251 and the input/output capacitors 254, thus obtaining a bandpass filter. A pole is provided on the lower band side in a passband by a sub line formed of the parallel bypass capacitors 252 and the series bypass capacitors 253.

Generally, in a dielectric filter, a group delay time is specified according to an amplifier system and a small deviation in group delay time within a frequency band, i.e. a flat in-band group delay time is required. In order to increase the group delay time while maintaining the deviation in the in-band group delay time, it is necessary to increase the number of stages in the filter. Furthermore, in order to broaden the frequency band with a uniform deviation in group delay time while maintaining the group delay time, it is required to increase the number of stages. However, the increase in the number of stages results in an increased loss.

Figure 26A:
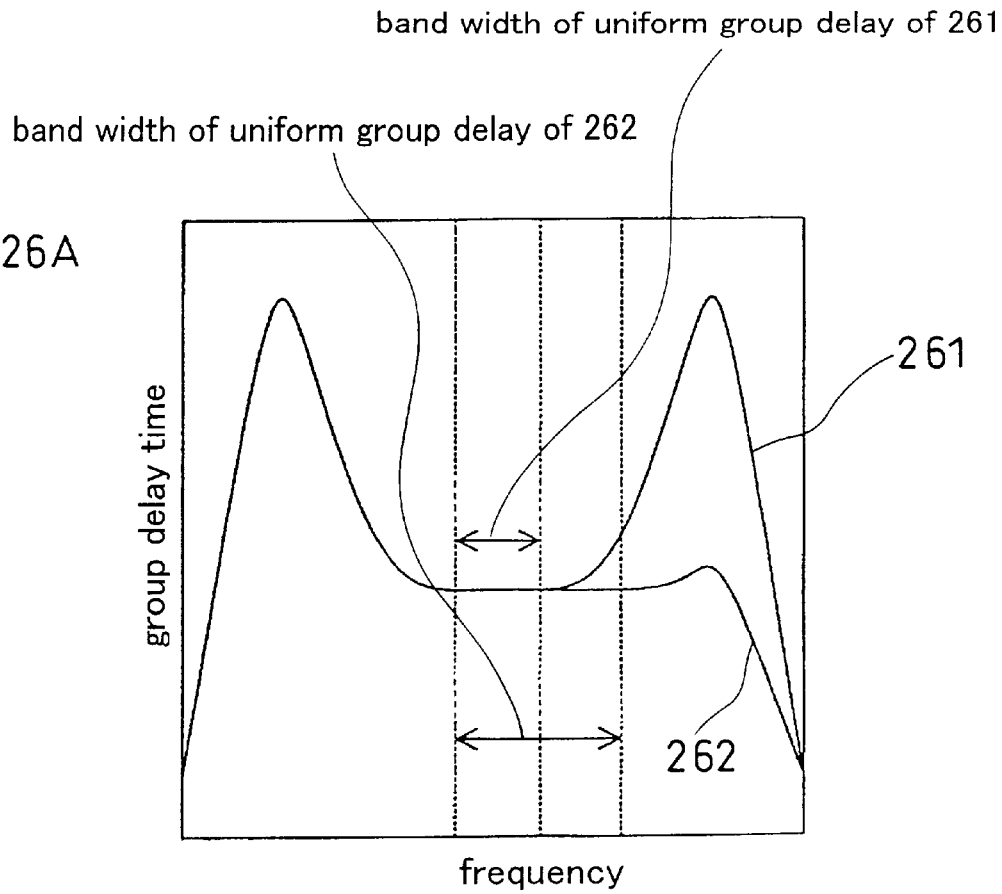
FIG. 26A is a diagram showing the comparison in group delay frequency characteristics between a 14-stage dielectric filter according to the sixth embodiment of the present invention and a conventional 14-stage dielectric filter.
Figure 26B:
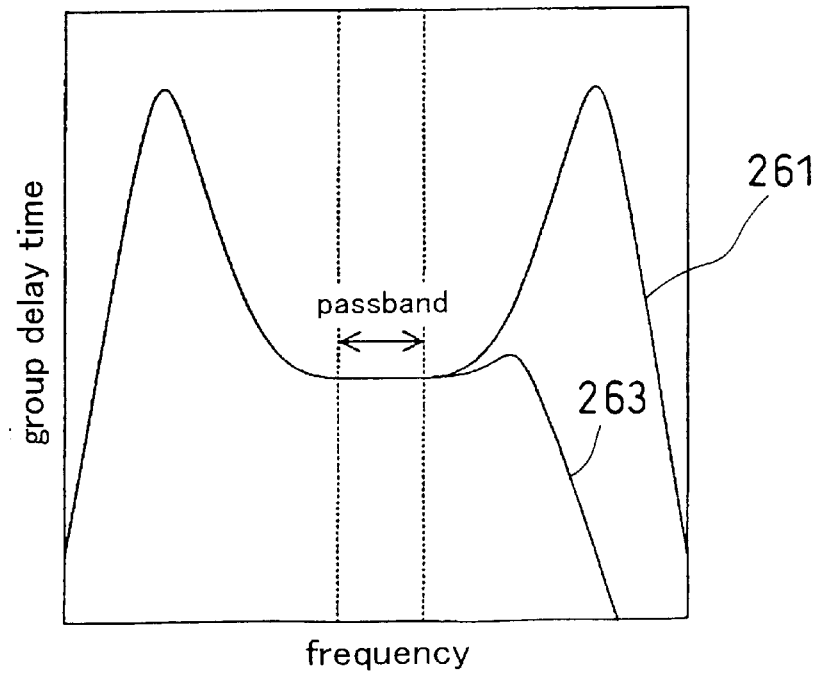
FIG. 26B is a diagram showing the comparison in group delay frequency characteristics between a 7-stage dielectric filter according to the sixth embodiment of the present invention and a conventional 14-stage dielectric filter.

FIG. 26A shows the comparison between the group delay frequency characteristics of a 14-stage dielectric filter according to the present invention and those of a conventional 14-stage dielectric filter. When compared to the group delay frequency characteristics of the conventional dielectric filter indicated by the curve 261, the group delay frequency characteristics of the 14-stage dielectric filter of the present invention, indicated by the curve 262, having the same number of stages as that of the conventional one, have a lower peak on the higher frequency band side in the frequency band, and thus a broader uniform-group-delay-time band width is obtained. As shown in FIG. 26B, in order to obtain the characteristics indicated by the curve 263 with the same band width and the same group delay time as those of the group delay frequency characteristics (indicated by the curve 261) of the conventional dielectric filter, the dielectric filter according to the present invention requires only 7 stages and thus the number of the stages can be reduced considerably, thus achieving the reductions in filter size and in loss.

In the group delay frequency characteristics of the dielectric filter according to the present invention, it also is possible to eliminate the peak on the higher frequency band side in the frequency band by regulation and thus to broaden the frequency band with a uniform deviation in group delay time.

Figure 27:
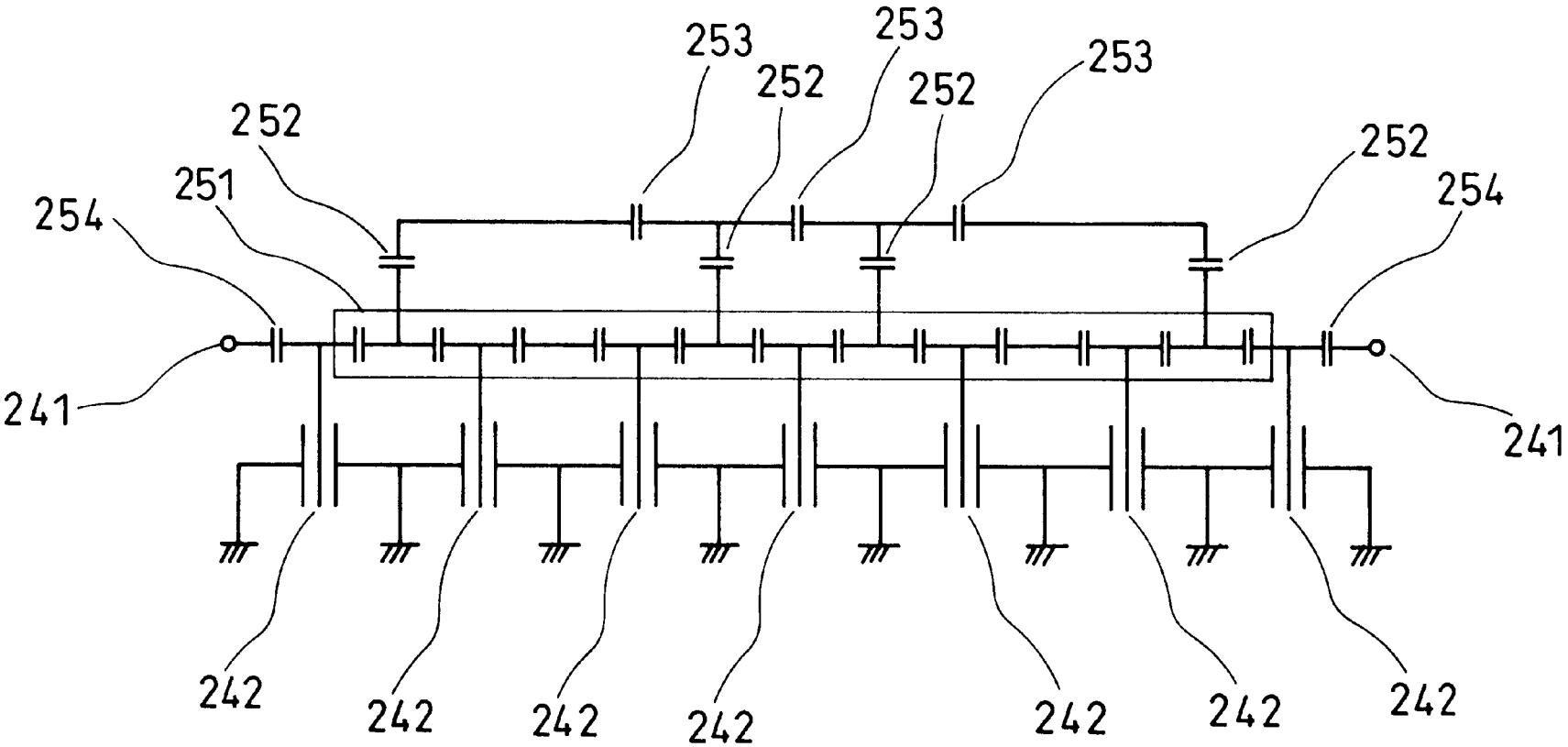
FIG. 27 is a schematic diagram of an equivalent circuit in which parallel bypass capacitors in the dielectric filter according to the sixth embodiment of the present invention are partially opened.

FIG. 27 shows a circuit in which the same characteristics as those obtained in the circuit shown in FIG. 25 can be obtained. In the circuit shown in FIG. 25, corresponding to the required center frequency, frequency band, group delay time, deviation in the group delay time, or the like, the capacitors such as the inter-stage coupling capacitors 251, the parallel bypass capacitors 252, the series bypass capacitors 253, the input/output capacitors 254, or the like are regulated. However, a part of the parallel bypass capacitors 252 may be regulated to have a very small value depending on the desired characteristics. In such a case, as shown in FIG. 27, it is possible to omit very small parallel bypass capacitors 252 and to open the portions where the parallel bypass capacitors 252 thus omitted were positioned. The omission of the parallel bypass capacitors 252 enables two successive series inter-stage coupling capacitors 251 to be replaced by one inter-stage coupling capacitor 251. Thus, while the same characteristics can be obtained, the number of components can be reduced.

FIG. 27 shows the case where some of the parallel bypass capacitors 252 are omitted. However, the same characteristics also can be obtained when some of the series bypass capacitors 253 are omitted.

In the above-mentioned embodiment, the half-wave dielectric resonators with both ends opened were used as the dielectric resonators 242. However, quarter-wave dielectric resonators with their ends short-circuited may be used in order to obtain the same characteristics.

SEVENTH EMBODIMENT

A seventh embodiment of the present invention is described with reference to the drawings as follows.

Figure 28:
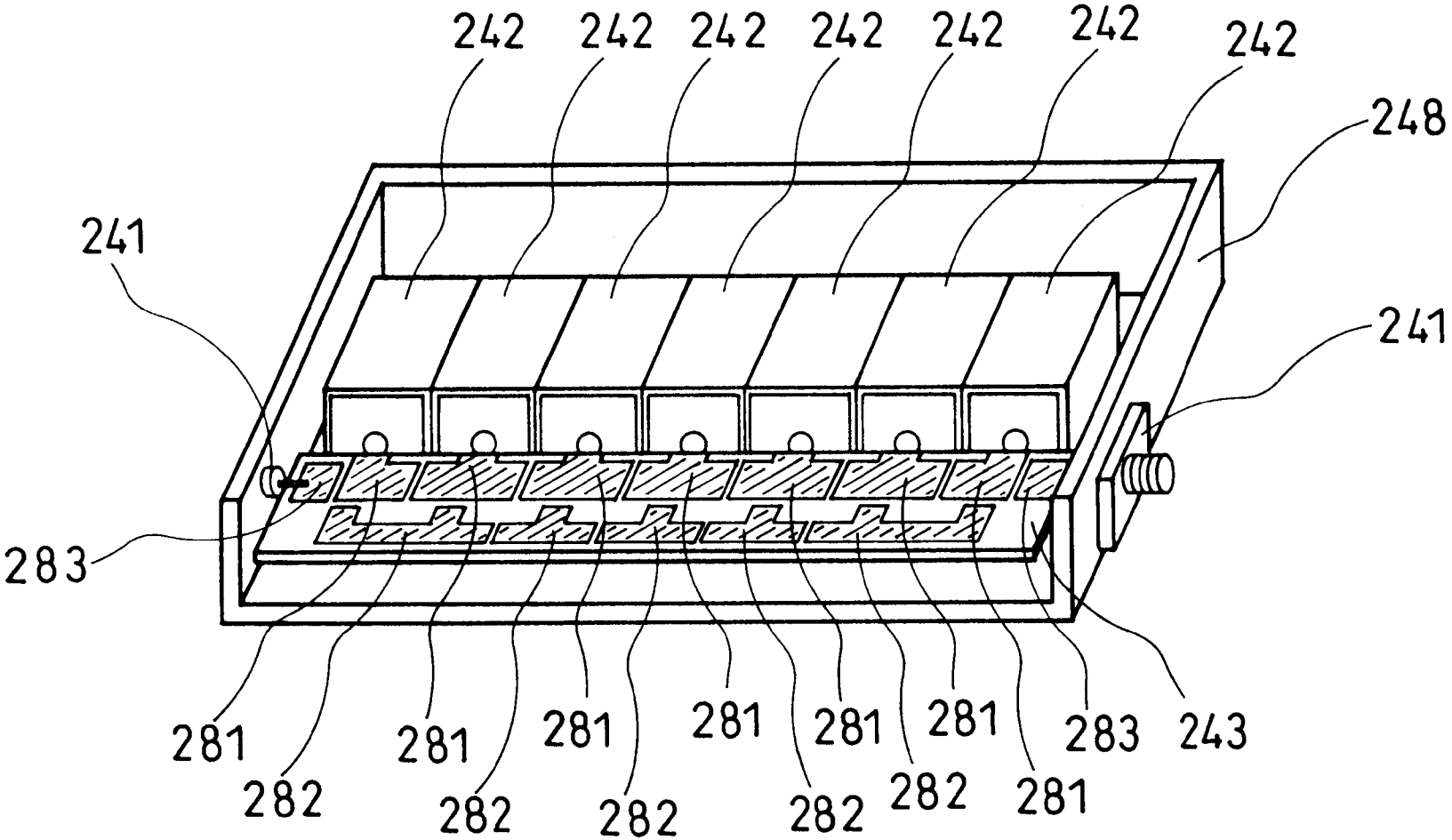
FIG. 28 is a perspective view of a dielectric filter according to a seventh embodiment of the present invention, which is shown with an upper wall and a part of side walls of its case being removed.

FIG. 28 is a perspective view showing a dielectric filter according to the seventh embodiment of the present invention, with its upper cover and a front face of a case 248 being removed. In FIG. 28, numerals 281 to 283 indicate copper-plated electrodes forming capacitors, and the same parts as those in FIG. 24 are indicated with the same numerals as in FIG. 24. The copper-plated electrodes 281 are electrically connected to internal conductors of dielectric resonators 242 with solder or the like, respectively. The copper-plated electrodes 282 are positioned so as to form parallel capacitors with the copper-plated electrodes 281. The copper plated electrodes 283 positioned outside the copper-plated electrodes 281 at both ends are connected to internal conductors of input/output terminals 241.

The configuration shown in FIG. 28 is different from that shown in FIG. 24 in that no copper-plated electrode is provided between the copper-plated electrodes 281.

Figure 29:
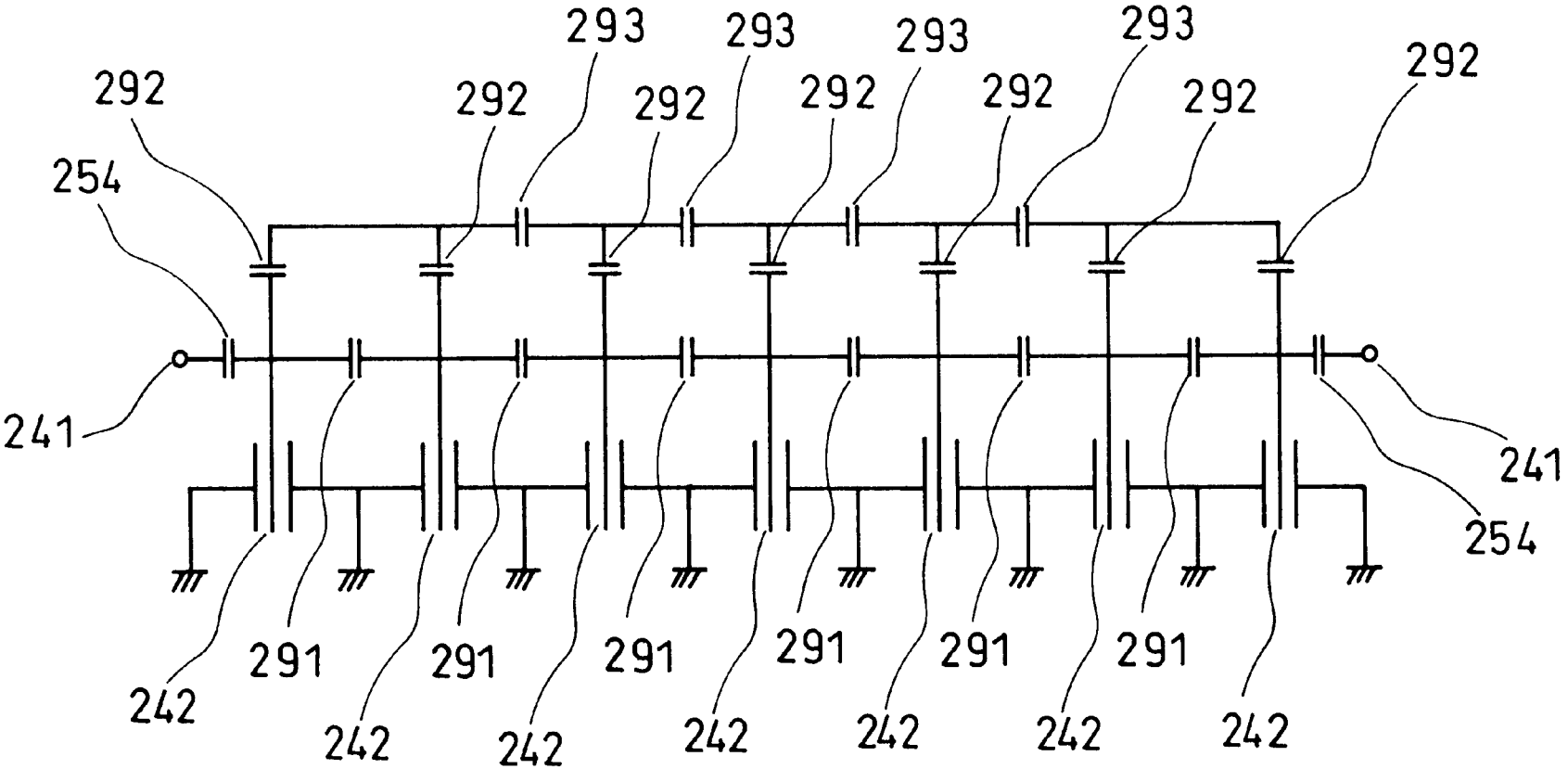
FIG. 29 is a schematic diagram of an equivalent circuit of the dielectric filter according to the seventh embodiment of the present invention.

FIG. 29 shows an equivalent circuit of the dielectric filter shown in FIG. 28 illustrating the seventh embodiment of the present invention. In FIG. 29, the same parts as those in FIG. 28 are indicated with the same numerals as in FIG. 28. Numeral 291 indicates inter-stage coupling capacitors formed between the respective copper-plated electrodes 281 shown in FIG. 28. Numeral 292 denotes parallel bypass capacitors formed of the copper-plated electrodes 281 and the copper-plated electrodes 282. Numeral 293 indicates series bypass capacitors formed between the respective copper-plated electrodes 282. The equivalent circuit shown in FIG. 29 is different from that shown in FIG. 25 in that the two inter-stage coupling capacitors between the dielectric resonators 242 are reduced to one and the parallel bypass capacitors are connected to points at which the series capacitors and the dielectric resonators 242 are connected.

According to the configuration as described above, while the same characteristics as those of the circuit shown in FIG. 25 are maintained, the numbers of the inter-stage coupling capacitors, parallel bypass capacitors, and series bypass capacitors are reduced, thus reducing the regulation difficulty.

With respect to the regulation method of changing the characteristics with peaks on both sides to the characteristics with one peak on only one side in group delay time characteristics by providing a pole, in the transfer characteristics described above, theoretical studies have not been completed, but it is possible to obtain target characteristics by varying the circuit constants using a circuit simulator.

The element values calculated by the circuit simulator have the following tendencies. In the circuit shown in FIG. 29, toward the center from the input/output terminals 241, the resonance frequency of the dielectric resonators 242 decreases and the capacitance values of the coupling capacitors and the parallel bypass capacitors decrease. The capacitance value of the series bypass capacitors increases toward the center. In some cases, however, these tendencies may not hold depending on the specifications and regulation of filters. In the circuit shown in FIG. 25, these tendencies do not hold due to the transformation from T type to Π type (Y-Δtransformation) in the circuit shown in FIG. 29.

Figure 30:
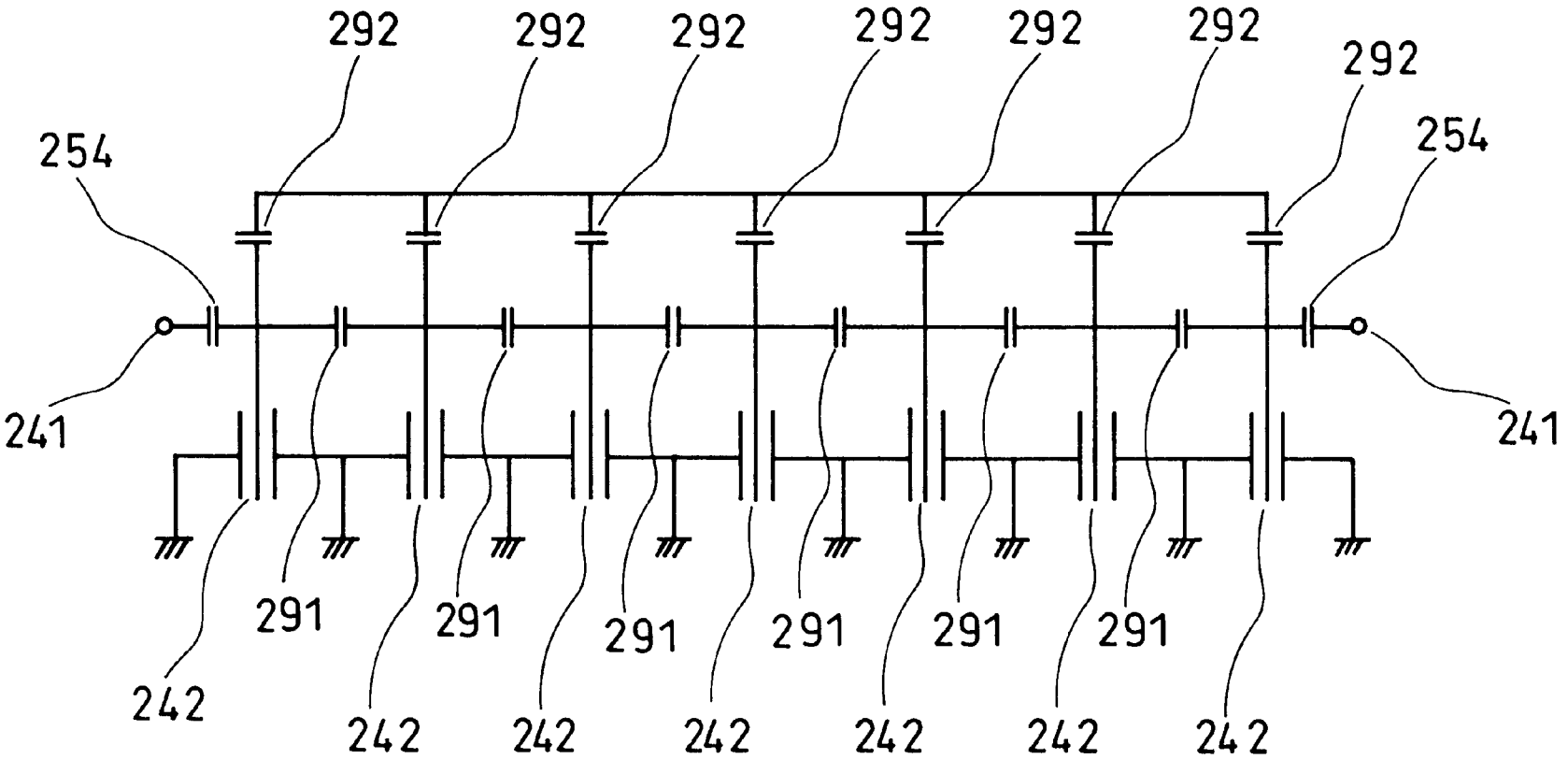
FIG. 30 is a schematic diagram of an equivalent circuit with short circuited series bypass capacitors in the dielectric filter according to the sixth embodiment of the present invention.
Figure 31:
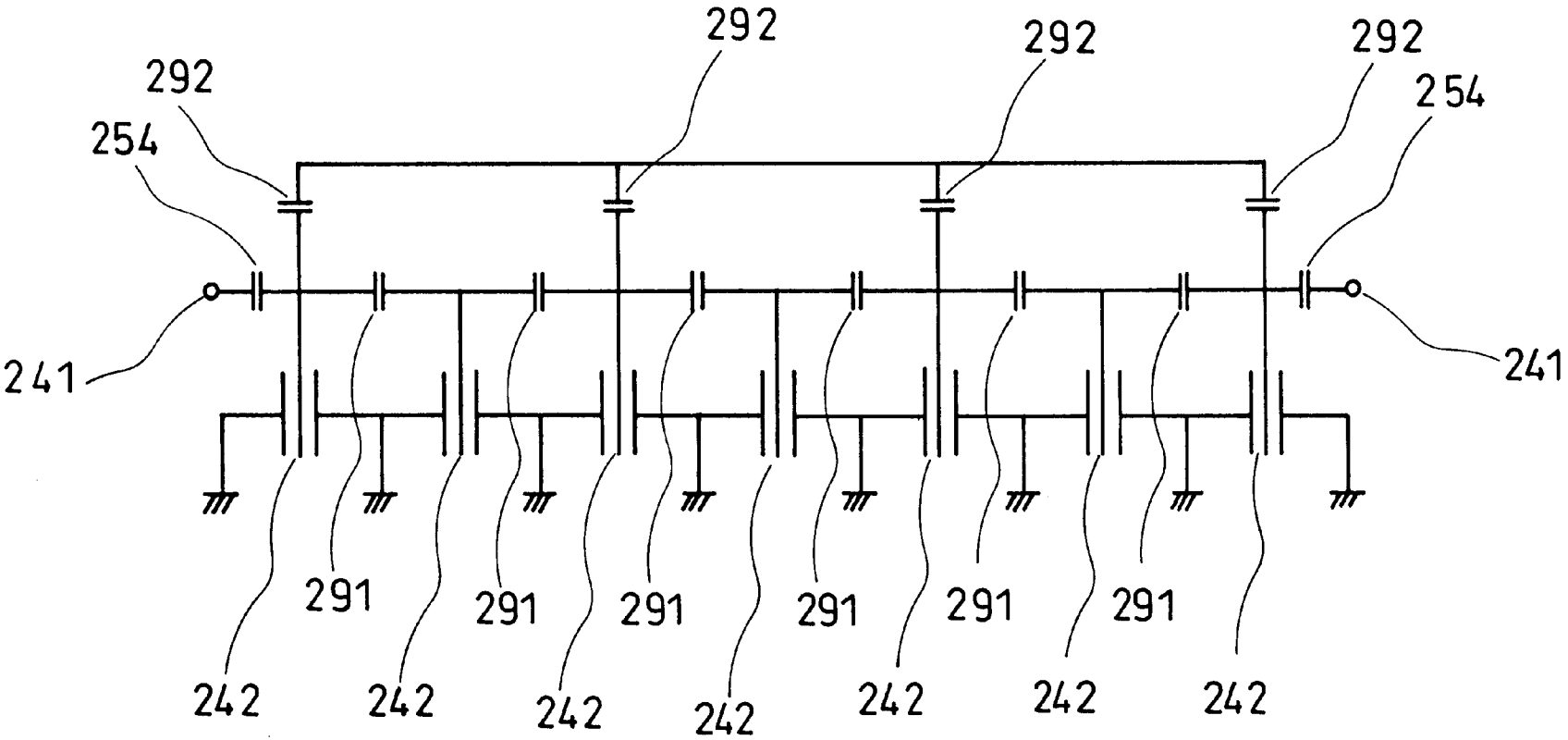
FIG. 31 is a schematic diagram of an equivalent circuit with partially opened parallel bypass capacitors in the dielectric filter according to the sixth embodiment of the present invention.

FIG. 30 shows a circuit in which the same characteristics as those obtained in the circuit shown in FIG. 29 can be obtained. In the circuit shown in FIG. 29, the capacitors such as the inter-stage coupling capacitors 291, the parallel bypass capacitors 292, the series bypass capacitors 293, the input/output capacitors 254, and the like are regulated according to the desired center frequency, frequency band, group delay time, variation in the group delay time, and the like, but the series bypass capacitors 293 may be regulated to have very high values depending on the desired characteristics. In such a case, as shown in FIG. 30, it is possible to omit very large series bypass capacitors 293 and to allow the portions where the very large series bypass capacitors 293 thus omitted were positioned to be short-circuited. This allows the number of components to be reduced while the same characteristics can be obtained, thus reducing the regulation difficulty. In addition, as shown in FIG. 31, the same characteristics also can be obtained by omitting minute parallel bypass capacitors 282 and opening the portions where they were positioned. Consequently, the number of components can be reduced further and thus the regulation difficulty can be reduced.

In the respective embodiments described above, the alumina coupling board was used as the coupling board. However, the coupling board is not limited to this and, for example, a glass-epoxy board or the like also can be used, which can reduce the cost.

Examples using the copper-plated electrodes as the electrodes were described in the above, but the electrodes are not limited to those. For example, solder can be used, which can reduce the cost.

Furthermore, in the respective embodiments described above, the capacitors are obtained by using gaps between copper-plated electrodes, but are not limited to those. For instance, capacitors of alumina whose upper and lower surfaces are plated with copper, or chip capacitors can be used. The use of alumina capacitors provides protection against discharges occurring between electrodes when a large current is input. The use of the chip capacitors improves the mass-productivity.

The above descriptions mainly were directed to examples using capacitors as reactive elements. However, the reactive elements are not limited to the capacitors, and for example, inductors can be used.

As described above, the in-band-flat-group-delay type dielectric filter of the present invention is formed of dielectric resonators and capacitors or inductors, and is a bandpass dielectric filter having a frequency band with uniform group delay time in resonance frequencies. Therefore, for example, when a cable-type delay device used in a feedforward linearized amplifier or the like is replaced by the dielectric filter of the present invention, great effects are provided in that due to a reduced loss, the load on the amplifier can be reduced and allowance in heat radiation design can be provided. In addition, the size reduction also can be achieved.

Moreover, the linearized amplifier of the present invention employs an in-band-flat-group-delay type dielectric filter of the present invention, thus particularly enabling the reduction in size of radio equipment in mobile communication base stations, the reduction in power consumption, simplification of a configuration relating to radiation, and the like. Consequently, a small base station equipment can be obtained.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. An in band-flat-group-delay type dielectric filter, comprising:

a plurality of dielectric coaxial resonators:

a coupling circuit comprising a combination of electrodes, with which respective internal conductors of the dielectric coaxial resonators are connected, so that the adjacently located dielectric coaxial resonators are coupled to one another through a coupling capacitor composed of the respective electrodes; and input/output terminals coupled to ends of the coupling circuit, wherein the dielectric coaxial resonators include dielectric coaxial resonators coupled to the input/output terminals and inter-stage dielectric coaxial resonators, and a characteristic impedance of the dielectric coaxial resonators coupled to the input/output terminals is different from that of the inter-stage dielectric coaxial resonators so as to broaden the passband of the dielectric filter.

2. The in-band-flat-group-delay type dielectric filter according to claim 1, wherein both deviations in group delay time and in amplitude between the input/output terminals fall within predetermined certain deviation values, respectively, at the same time at a center frequency and within a specified frequency band around the center frequency, and a minimum value of a group delay time within a passband is at least one nanosecond.

3. The in-band-flat-group-delay type dielectric filter according to claim 1, wherein the dielectric coaxial resonators coupled to the input/output terminals are half-wave dielectric resonators with their both ends opened.

4. The in-band-flat-group-delay type dielectric filter according to claim 1, wherein the dielectric coaxial resonators coupled to the input/output terminals are quarter-wave dielectric resonators with their one ends short-circuited, and the inter-stage dielectric coaxial resonators are half-wave dielectric resonators with their both ends opened.

5. The in-band-flat-group-delay type dielectric filter according to claim 1, wherein the characteristic impedance of the dielectric coaxial resonators coupled to the input/output terminals is made different from that of the inter-stage dielectric coaxial resonators by using dielectric materials with different dielectric constants.

6. The in-band-flat-group-delay type dielectric filter according to claim 1, wherein the characteristic impedance of the dielectric coaxial resonators coupled to the input/output terminals is made different from that of the inter-stage dielectric coaxial resonators by making diameter ratios of the dielectric coaxial resonators coupled to the input/output terminals and the inter-stage dielectric coaxial resonators to be different from each other.

7. The in-band-flat-group-delay type dielectric filter according to claim 1, further comprising a transmission line and a directional coupler, wherein the coupling circuit is formed of capacitors, which are formed on a coupling board formed on a dielectric substrate, with which the dielectric coaxial resonators are coupled to one another, and an in-band-flat-group-delay type dielectric filter, which includes the coupling board and the dielectric coaxial resonators, and the directional coupler are combined via the transmission line to form one body.

8. The in-band-flat-group-delay type dielectric filter according to claim 7, wherein the coupling circuit is formed by forming the capacitors on a first dielectric substrate, the directional coupler is formed on a second dielectric substrate, and the first dielectric substrate and the second dielectric substrate are combined to form one body.

9. The in-band-flat-group-delay type dielectric filter according to claim 1, further comprising metallic screw tuners positioned adjacent to and in parallel to open ends of the dielectric coaxial resonators, wherein resonance frequencies of the dielectric coaxial resonators can be regulated by varying distances between the screw tuners and the dielectric coaxial resonators.

10. The in-band-flat-group-delay type dielectric filter according to claim 1, further comprising:

metal fittings for frequency regulation electrically connected to internal conductors of the dielectric coaxial resonators; and metallic screw tuners positioned adjacent to and in parallel to the metal fittings for frequency regulation, wherein resonance frequencies of the dielectric coaxial resonators can be regulated by varying distances between the metal fittings for frequency regulation and the screw tuners.

11. The in-band-flat-group-delay type dielectric filter according to claim 1, wherein metallic screw tuners provided movably in a direction perpendicular to open ends of the dielectric coaxial resonators are inserted into inner holes of the dielectric coaxial resonators via dielectrics or insulators, and by varying lengths of portions of the metallic screw tuners inserted into the inner holes resonance frequencies of the dielectric coaxial resonators can be regulated.

12. The in-band-flat-group-delay type dielectric filter according to any one of claims 9 to 11, wherein the screw tuners are attached to a case with one ends of the screw tuners being exposed to the outside of the case, and resonance frequencies can be regulated by regulating positions of the screw tuners from the outside of the case.

13. An in-band-flat-group-delay type dielectric filter, comprising:

a plurality of filter blocks, each of which is formed of an in-band-flat-group-delay type dielectric filter according to claim 1; and a transmission line, wherein the plurality of filter blocks are cascaded with the transmission line having a characteristic impedance whose value is substantially the same as that of an input/output impedance.

14. The in-band-flat-group-delay type dielectric filter according to claim 13, wherein the plurality of filter blocks are separated by shielding cases individually.

15. The in-band-flat-group-delay type dielectric filter according to claim 1, wherein a uniform-group-delay frequency band is within a passband in amplitude transfer characteristics and a variation in amplitude in the amplitude transfer characteristics within the uniform-group-delay frequency band is smaller than that in amplitude in the whole passband in the amplitude transfer characteristics outside the uniform-group-delay frequency band.

16. The in-band-flat-group-delay type dielectric filter according to claim 15, wherein a minimum value of insertion loss within the passband in the amplitude transfer characteristics falls within the uniform-group-delay frequency band.

17. The in-band-flat-group-delay type dielectric filter according to claim 1, wherein a uniform-group-delay frequency band is within a passband in amplitude transfer characteristics and a center frequency of the uniform-group-delay frequency band is higher than that of the passband in the amplitude transfer characteristics.

18. The in-band-flat-group-delay type dielectric filter according to claim 1, wherein a uniform-group-delay frequency band is within a passband in amplitude transfer characteristics and the passband in the amplitude transfer characteristics has a width at least twice as wide as that of the uniform-group-delay frequency band.

19. The in-band-flat-group-delay type dielectric filter according to claim 1, wherein frequency characteristics in group delay time have peak values at both edges of a passband in amplitude transfer characteristics and one of the peak values on a lower edge side of the passband in the amplitude transfer characteristics is larger than the other of the peak values on an upper edge side.

20. The in-band-flat-group-delay type dielectric filter according to claim 1, wherein a return loss within a uniform-group-delay frequency band has a ripple, and a minimum value of the ripple within the uniform-group-delay frequency band is larger than that of a ripple in a return loss outside the uniform-group-delay frequency band and decreases from a center portion toward both edges of a passband in amplitude transfer characteristics.

* * * * *